US007757671B2

(12) United States Patent
Danjo et al.

(10) Patent No.: US 7,757,671 B2
(45) Date of Patent: Jul. 20, 2010

(54) FUEL FEED APPARATUS

(75) Inventors: Hajime Danjo, Kariya (JP); Masashi Otsuka, Kariya (JP); Akihide Hashi, Kariya (JP); Kouji Maruyama, Aichi-gun (JP); Masaaki Konishi, Chiryu (JP)

(73) Assignee: Denso Corporation, Kariya (JP)

( * ) Notice: Subject to any disclaimer, the term of this patent is extended or adjusted under 35 U.S.C. 154(b) by 92 days.

(21) Appl. No.: 11/905,405

(22) Filed: Sep. 28, 2007

(65) Prior Publication Data

US 2009/0013970 A1 Jan. 15, 2009

(30) Foreign Application Priority Data

Sep. 29, 2006 (JP) ..... 2006-267670
Jan. 16, 2007 (JP) ..... 2007-007474

(51) Int. Cl.
*F02M 37/04* (2006.01)

(52) U.S. Cl. ..... 123/509

(58) Field of Classification Search ..... 123/509
See application file for complete search history.

(56) References Cited

U.S. PATENT DOCUMENTS 4,869,225 A * 9/1989 Nagata et al. ..... 123/509
5,070,849 A * 12/1991 Rich et al. ..... 123/509
5,080,077 A * 1/1992 Sawert et al. ..... 123/514
5,218,942 A * 6/1993 Coha et al. ..... 123/514
5,330,475 A * 7/1994 Woodward et al. ..... 417/89
5,415,146 A * 5/1995 Tuckey ..... 123/509
5,452,701 A * 9/1995 Tuckey ..... 123/509
5,769,061 A * 6/1998 Nagata et al. ..... 123/509
5,960,775 A * 10/1999 Tuckey ..... 123/509
6,123,511 A * 9/2000 Sertier ..... 417/87
6,155,793 A * 12/2000 Tuckey et al. ..... 417/87
6,260,543 B1 * 7/2001 Chih ..... 123/509
6,343,589 B1 * 2/2002 Talaski et al. ..... 123/514
6,425,378 B1 * 7/2002 Frank ..... 123/514
6,457,945 B2 10/2002 Kleppner et al.
6,488,476 B2 12/2002 Eck
6,619,272 B2 * 9/2003 Jones et al. ..... 123/514
6,679,226 B2 * 1/2004 Burke et al. ..... 123/509
6,705,298 B2 * 3/2004 Ramamurthy et al. ..... 123/509

(Continued)

FOREIGN PATENT DOCUMENTS

EP 1 709 885 11/2006

(Continued)

OTHER PUBLICATIONS

Japanese Office Action dated Mar. 30, 2010, issued in corresponding Japanese Application No. 2006-267670, with English translation.

*Primary Examiner*—Thomas N Moulis
(74) *Attorney, Agent, or Firm*—Nixon & Vanderhye, PC

(57) ABSTRACT

A fuel feed apparatus includes a sub-tank that is received in the fuel tank and a fuel pump that is received in the sub-tank and pumps fuel in the sub-tank toward the outside of the fuel tank. The sub-tank has a bottom wall that has a first passageway extending in the axial direction of the sub-tank, to which a suction jet pump unit to suction fuel in the fuel tank into the sub-tank can be selectively mounted.

17 Claims, 18 Drawing Sheets

U.S. PATENT DOCUMENTS

| | | | | |
|---|---|---|---|---|
| 6,718,952 | B2 * | 4/2004 | Finch | 123/509 |
| 6,792,923 | B2 * | 9/2004 | Kumagai et al. | 123/509 |
| 6,832,627 | B2 * | 12/2004 | Braun et al. | 137/565.22 |
| 6,951,208 | B2 * | 10/2005 | Milton | 123/509 |
| 6,981,490 | B2 | 1/2006 | Nagata et al. | |
| 7,069,914 | B2 | 7/2006 | Nagata | |
| 7,117,856 | B2 * | 10/2006 | Honda et al. | 123/514 |
| 7,252,075 | B2 * | 8/2007 | Firtion et al. | 123/509 |
| 7,303,378 | B2 * | 12/2007 | Kleppner et al. | 417/87 |
| 2003/0127075 | A1 | 7/2003 | Braun et al. | |
| 2004/0177886 | A1 | 9/2004 | Nagata et al. | |
| 2006/0021603 | A1 | 2/2006 | Nagata | |

FOREIGN PATENT DOCUMENTS

| | | |
|---|---|---|
| JP | 02-083367 | 3/1990 |
| JP | 2000-257525 | 9/2000 |
| JP | 2005-351170 | 10/2005 |
| JP | 2006-083747 | 3/2006 |
| WO | WO 2005/021955 | 3/2005 |

* cited by examiner

FUEL FEED APPARATUS

CROSS REFERENCE TO RELATED APPLICATION

This application is based upon, claims priority from and incorporates herein by reference the contents of Japanese Patent Applications No. 2006-267670 filed on Sep. 29, 2006 and No. 2007-7474 filed on Jan. 16, 2007.

FIELD OF THE INVENTION

The present invention relates to a fuel feed apparatus for use in an automotive fuel system.

BACKGROUND OF THE INVENTION

A fuel feed apparatus includes a sub-tank received in a fuel tank, a fuel pump received in the sub-tank to supply fuel in the fuel tank to the outside of the fuel tank through the sub-tank, and a jet pump unit to supply fuel in the fuel tank into the sub-tank.

The jet pump unit includes a jet nozzle to generate suction power within the jet pump unit, a throat pipe communicated with the inside of the sub-tank, and a suction port to connect the throat pipe and the outside of the sub-tank. In this structure, fuel is jetted from the jet nozzle toward the throat pipe so that suction power is generated within the jet pump. Thus, fuel in the fuel tank is suctioned from the fuel tank into the sub-tank through the suction port and the throat pipe.

A fuel feed apparatus disclosed in JP-A-2004-108380, JP-A-2001-3826 and JP-A-2003-536006 has a jet pump unit to supply fuel in the fuel tank into the sub-tank, which is combined with a fuel pump. However, with this structure, when the specifications of the jet pump unit are altered, the structure of the fuel pump must be altered.

Furthermore, a fuel feed apparatus disclosed in JP-A-2001-207929 and JP-A-2005-351170 has a jet pump unit that is formed integrally with a sub-tank by using resin. However, with this structure, when the specifications of the jet pump unit are altered, the structure of the sub-tank must be altered.

Thus, the fuel pump and the sub-tank of the fuel feed apparatus cannot be standardized due to varying specifications of the jet pump unit.

Moreover, the jet nozzle of the jet pump unit of the fuel feed apparatus disclosed in JP-A-2001-207929 is provided on the lower side of the jet pump unit, and jets fuel upward. The suction port is formed on the lower side of the sub-tank. The outlet port of the throat pipe is opened upward, and is positioned on the upper side of the sub-tank. Fuel in the fuel tank is drawn into the sub-tank through the suction port and the outlet port of the throat pipe.

In this structure, fuel is discharged from the outlet port in all circumferential directions of the outlet port. In this case, when the outlet port of the jet pump unit is provided near the upper edge of the sub-tank, part of fuel discharged from the outlet port flows outside of the sub-tank. Therefore, the outlet port must be positioned below the upper edge of the sub-tank, so as to prevent part of the fuel discharged from the outlet port from flowing outside of the sub-tank.

Consequently, when the fuel pump is stopped, fuel in the sub-tank flows into the outlet port, and flows out of the sub-tank through the throat pipe and the suction port. This outflow of fuel will stop when fuel level in the sub-tank is the same level as the outlet port. Accordingly, the higher the outlet port is positioned in the sub-tank, the higher the fuel level in the sub-tank can be after the fuel pump stops, and the more fuel can be stored within the sub-tank. On the other hand, the lower the outlet port of the throat pipe is positioned in the sub-tank, the lower the fuel level in the sub-tank will be after the fuel pump is stopped, and a lesser amount of fuel will be stored within the sub-tank.

Considering this point, in the structure that the height of the outlet port of the jet pump unit is restricted, as disclosed in JP-A-2001-207929, it is difficult to store more amount of fuel within the sub-tank once the fuel pump has stopped.

In another case, a fuel feed apparatus received in a fuel tank that includes a plurality of tank sections (e.g. saddle-shaped fuel tank) is disclosed in JP-A-2004-316567. The fuel feed apparatus disclosed in JP-A-2004-316567 has a sub-tank that includes two jet pumps, a suction jet pump to draw fuel in one tank section into the sub-tank and a transfer jet pump to draw fuel in other tank section into the sub-tank.

In this structure, the jet nozzle of the transfer jet pump unit of the fuel feed apparatus is provided on the upper side of the transfer jet pump unit, and jets fuel downward. In this structure, a passage to supply fuel to the jet nozzle must be arranged above the jet nozzle, parallel to the transfer jet pump body. Thus, the transfer jet pump unit accounts for a larger portion of the inner volume of the sub-tank. Therefore, it is difficult to receive two jet pump units, the suction jet pump unit and the transfer jet pump unit, within the sub-tank. In this case, when two jet pump units must be received within the sub-tank, the amount of fuel that the sub-tank can store is reduced by the volume of the two jet pump units.

SUMMARY OF THE INVENTION

In view of the foregoing problems, it is a first object of the present invention to propose an fuel feed apparatus, in which the fuel pump and sub-tank of the fuel feed apparatus can be standardized regardless of the specifications of the jet pump unit. The second object of the present invention is to propose an fuel feed apparatus, in which as much fuel as possible can be stored within the sub-tank.

According to the present invention, a fuel feed apparatus includes a sub-tank that is received in the fuel tank and has a bottom wall and a fuel pump that is received in the sub-tank and pumps fuel in the sub-tank toward the outside of the fuel tank. The bottom wall of the sub-tank has a first passageway extending in the axial direction of the sub-tank, to which a suction jet pump unit to suction fuel in the fuel tank into the sub-tank can be selectively mounted.

Furthermore, the fuel feed apparatus includes a suction jet pump unit that is mounted in the first passageway and suctions fuel in the fuel tank into the sub-tank. The suction jet pump unit includes a first suction port, a first outlet, and a first joint member. The first suction port is disposed at the upstream end and is communicated with the outside of the sub-tank. The first outlet port is disposed adjacent to the upper edge of the sub-tank and is opened at the downstream end toward the inside of the sub-tank. The first joint member is provided at the downstream end and has an engaging member which clips onto the upper edge of a sidewall of the sub-tank.

BRIEF DESCRIPTION OF THE DRAWINGS

The above and other objects, features and advantages of the present invention will become more apparent from the following detailed description with reference to the accompanying drawings. In the drawings.

DETAILED DESCRIPTION OF THE PREFERRED EMBODIMENTS

First Embodiment

Figure 1:
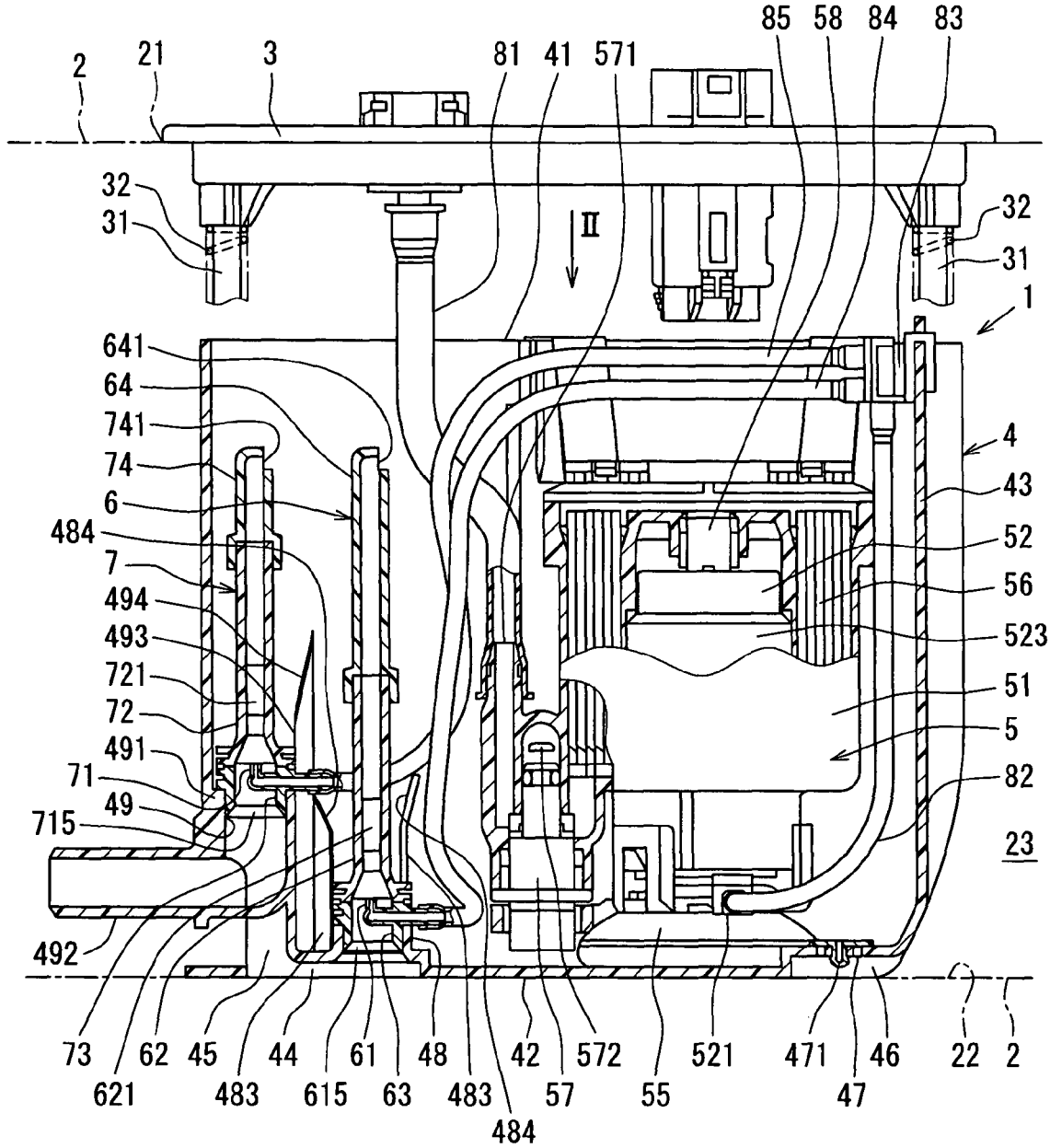
FIG. 1 is a schematic cross-sectional view showing a fuel feed apparatus accommodated in a fuel tank according to the first embodiment of the present invention.
Figure 2:
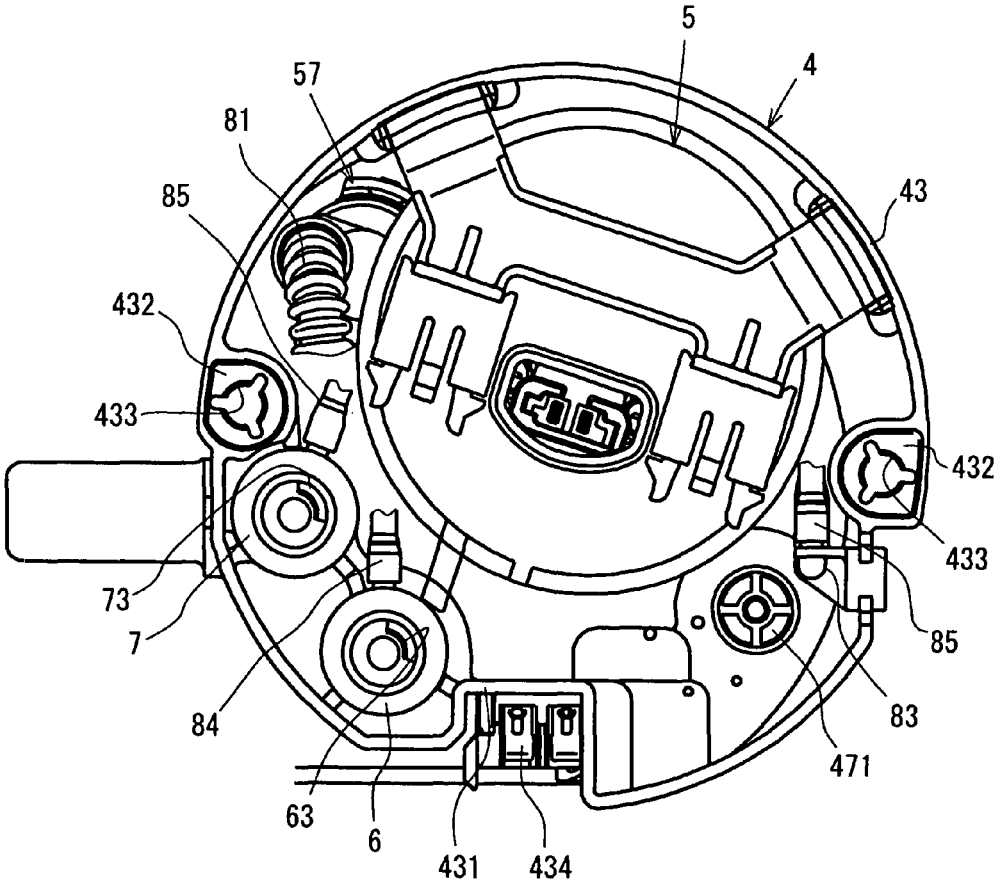
FIG. 2 is a top view from the direction II in FIG. 1.

As shown in FIGS. 1 and 2, a fuel feed apparatus 1 is received in a fuel tank 2 for transferring fuel in the fuel tank 2 to an exterior device, such as an engine, provided outside of the fuel tank 2. The fuel feed apparatus 1 is mounted on a bottom wall 22 of the fuel tank 2. The fuel tank 2 is a saddle-shaped fuel tank that includes a first tank section 23 and a second tank section (not shown). The fuel feed apparatus 1 is received in the first tank section 23. A flange 3 of the fuel feed apparatus 1 is mounted on a top wall of the fuel tank 2, so as to cover an opening 21 of the fuel tank 2.

The fuel feed apparatus 1 includes a sub-tank 4, a pump module 5, a suction jet pump unit 6, a transfer jet pump unit 7, and the like. The sub-tank 4 is received in the fuel tank 2 and a pump module 5 is received in the sub-tank 4. Shafts (i.e. connecting members) 31 are fixed with the flange 3 at one ends, and are slidably inserted into insertion sections 432 formed in the sub-tank 4 at the other ends. Specifically, the insertion sections 432 are formed in a section of the sidewall 43 that is recessed in the diametrical direction of the sub-tank 4. The insertion sections 432 are insertion holes 433. Shafts 31 slidably inserted into the insertion holes 433 of the insertion sections 432. Springs 32 are provided around the shafts 31 so that the flange 3 and the sub-tank 4 are biased apart from each other. Expansion and shrinkage may arise in the fuel tank 2, which is made of resin, as inner pressure of the fuel tank 2 varies. The inner pressure of the fuel tank 2 varies due to a temperature variation or a variation of the amount of fuel contained in the fuel tank 2. Even if expansion or shrinkage arises in the fuel tank 2, the bottom wall 41 of the sub-tank 4 is held pressed onto the bottom inner surface of the fuel tank 2 by the force of the springs 32.

The sub-tank 4 is made of resin. The sub-tank 4 has a opening 41 at the upper end and a bottom wall 42 at the lower end, that is to say, the sub-tank 4 is formed in a bottomed cylindrical shape. A sidewall 43 of the sub-tank 4 of the fuel feed apparatus 1 is partially recessed in the diametrical direction of the sub-tank 4, so as to form a step section 431 as shown in FIG. 2. The sub-tank 4 is formed in a substantially cylindrical shape, except for the step section 431. The step section 431 is formed to be flat. A sender gauge 434 to measure the level of fuel in a fuel tank 2 is provided in the step section 431.

The bottom wall 42 of the sub-tank 4 is partially recessed in the axial direction of the sub-tank 4, so as to form a first step section. The first step section forms a gap 44 between the bottom wall 42 of the sub-tank 4 and a bottom wall 22 of the fuel tank 2. A first passageway 48 extending in the axial direction of the sub-tank 4 is formed in the first step section that forms the gap 44. In this structure, fuel in the first tank section 23 of the fuel tank 2 is drawn into the sub-tank 4 through the first passageway 48, when the suction jet pump unit 6 is driven.

Furthermore, the bottom wall 42 of the sub-tank 4 is partially recessed in the axial direction of the sub-tank 4, so as to form a second step section. The second step section forms a gap 45, which is larger than the gap 44, between the bottom wall 42 of the sub-tank 4 and a bottom wall 22 of the fuel tank 2. The gap 45 is adjacent to the gap 44, as shown in FIG. 1. A second passageway 49 is formed in the second step section that forms the gap 45. In this structure, fuel in the second tank section (not shown) of the fuel tank 2 is drawn into the sub-tank 4 through the second passageway 49, when the transfer jet pump unit 7 is driven.

Further, the bottom wall 42 of the sub-tank 4 is partially recessed in the axial direction of the sub-tank 4, so as to form a third step section. The third step section forms a gap 46 between the bottom wall 42 of the sub-tank 4 and a bottom wall 22 of the fuel tank 2. The gap 46 is not adjacent to the gap 44 and the gap 45, as shown in FIG. 1. An opening 47 is formed in the third step section that forms the gap 46. A check valve 471 is provided on the opening 47. Fuel in the first tank section 23 of the fuel tank 2 is drawn into the sub-tank 4 through the check valve 471.

The pump module 5 includes a casing 51, a fuel pump 52, a suction filter 55, a fuel filter 56, and a pressure regulator 57. The fuel pump 52 is received in the casing 51. The suction filter 55 is connected to the upstream side of the fuel pump 52.

On the other hand, the fuel filter 56 is connected to the downstream side of the fuel pump 52. The fuel filter 56 is received in the casing 51, and surrounds the fuel pump 52 in the circumferential direction of the fuel pump 52. A discharge port 571 of the pressure regulator 57 is connected with a discharge port of the flange 3 by using a flexible tube 81.

The fuel pump 52 includes a pump section 521 and an electric motor section 523. The pump section 521 includes a pump housing (not shown) and an impeller (not shown) housed in the pump housing. The pump housing is connected with a pipe 82. Accordingly, when fuel in the sub-tank 4 is drawn by the fuel pump 52 through the suction filter 55 into the pump housing, fuel drawn by the fuel pump 52 can be divided and supplied to the pipe 82 and the fuel filter 56 through the pump housing.

Fuel discharged into the fuel filter 56 is supplied to an engine provided outside of the fuel tank 2 through the pressure regulator 57, the flexible tube 81, and the flange 3. However, when the pressure of fuel discharged into the fuel filter 56 is above a predetermined pressure (e.g. above about 400 kPa), such a fuel is discharged from a drain port 572 of the pressure regulator 57 into the sub-tank 4.

Pipe 82 is connected with a joint member 83 at the downstream end of the pipe 82. The joint member 83 is fixed on the edge of the opening 41 of the sub-tank 4, and is connected with two pipes 84,85. Pipe 84 is connected with the suction jet pump unit 6 at its downstream end, and pipe 85 is connected with the transfer jet pump unit 7 at its downstream end. A vent hole is formed in the joint member 83. Thus, when the fuel pump 52 is stopped, the vent hole can prevent fuel in the sub-tank 4 from flowing out of the sub-tank 4 through pipes 82,84 and the first passageway 48, or through pipes 82,85 and the second passageway 49 by siphon action.

The pump module 5 includes a check valve 58 within the casing 51. The check valve 58 is positioned on the downstream side of the pump housing. The check valve 58 can prevent fuel in pipe 81 from flowing back into the fuel pump 52 and draining from the suction filter 55, when the fuel pump 52 is stopped. As a result, when the fuel pump 52 is stopped, fuel pressure in pipe 81 can be maintained a predetermined pressure.

The suction jet pump unit 6 is made of resin, and includes a jet nozzle 61, a throat pipe 62, a chamber member 63, and an extended pipe 64. The jet nozzle 61 is received in the chamber member 63, and jets fuel supplied from the pipe 84. The throat pipe 62 includes a throat passageway 621. Fuel jetted from the jet nozzle 61 flows through the throat passageway 621, forming a liquid seal that obstructs the throat passageway 621. As a result, suction power is generated within the suction jet pump unit 6, so that fuel is suctioned from a suction port 615 formed in the chamber member 63.

Fuel suctioned from the suction port 615 flows with fuel jetted from the jet nozzle 61 sequentially through the throat pipe 62 and the extended pipe 64, and is supplied into the sub-tank 4 through an outlet port 641. Therefore, when the fuel pump 52 is driven and fuel is jetted from the jet nozzle 61, fuel in the first tank section 23 is supplied into the sub-tank 4 through the gap 44, the first passageway 48 of the sub-tank 4, the suction port 615, the throat passageway 621, and an outlet port 641.

In this embodiment, jet nozzle 61 to jet fuel upward is integrally formed with the chamber member 63 by using resin. The chamber member 63 is connected with the throat pipe 62 by welding. The throat pipe 62 is joined with the extended pipe 64. The throat pipe 62 and the extended pipe 64 extend from the chamber member 63 in the axial direction of the sub-tank 4. Thus, the extended pipe 64 extends the length of the passageway within the suction jet pump unit 6 in the axial direction of the sub-tank 4.

The transfer jet pump unit 7 is made of resin, and includes a jet nozzle 71, a throat pipe 72, a chamber member 73, and an extended pipe 74, as with the suction jet pump unit 6.

Jet nozzle 71 is received in the chamber member 73, and jets fuel supplied from pipe 85. The throat pipe 72 includes a throat passageway 721. Fuel jetted from jet nozzle 71 flows through the throat passageway 721. As a result, suction power is generated within the transfer jet pump unit 7, so that fuel is suctioned from a suction port 715 formed in the chamber member 73. Fuel suctioned from the suction port 715 flows with fuel jetted from jet nozzle 71 sequentially through the throat pipe 72 and the extended pipe 74, and is supplied into the sub-tank 4 through an outlet port 741.

A connector 492, which is a L-shaped pipe, is connected with the second passageway 49 of the sub-tank 4, as shown in FIG. 1. The connector 492 is connected with a transfer pipe (not shown) communicated with the second tank section. Therefore, when the fuel pump 52 is driven and fuel is jetted from the jet nozzle 71, fuel in the second tank section is supplied into the sub-tank 4 through the transfer pipe, the connector 492, the second passageway 49 of the sub-tank 4, the suction port 715, the throat passageway 721, and an outlet port 741. According to this structure, the sub-tank 4 can be filled with fuel due to the transfer of fuel from the second tank section, even if the amount of fuel in the first tank section 23 decreases.

In this embodiment, jet nozzle 71 is integrally formed with the chamber member 73 using resin. The chamber member 73 is connected with the throat pipe 72 by welding. The throat pipe 72 is jointed with the extended pipe 74. The throat pipe 72 and the extended pipe 74 extend from the chamber member 73 in the axial direction of the sub-tank 4. Thus, the extended pipe 74 extends the length of the passageway within the transfer jet pump unit 7 in the axial direction of the sub-tank 4.

Hereinafter, the structure to install the suction jet pump unit 6 and the transfer jet pump unit 7 within the sub-tank 4 is described in detail. The sidewall 481 of the first passageway 48 of the sub-tank 4 protrudes toward the inside of the sub-tank 4 in the axial direction of the sub-tank 4. The first passageway 48 is formed as a hollow-cylinder. The suction jet pump unit 6 to supply fuel in the first tank section 23 of the fuel tank 2 into the sub-tank 4 is mounted in the first passageway 48.

Figure 3:
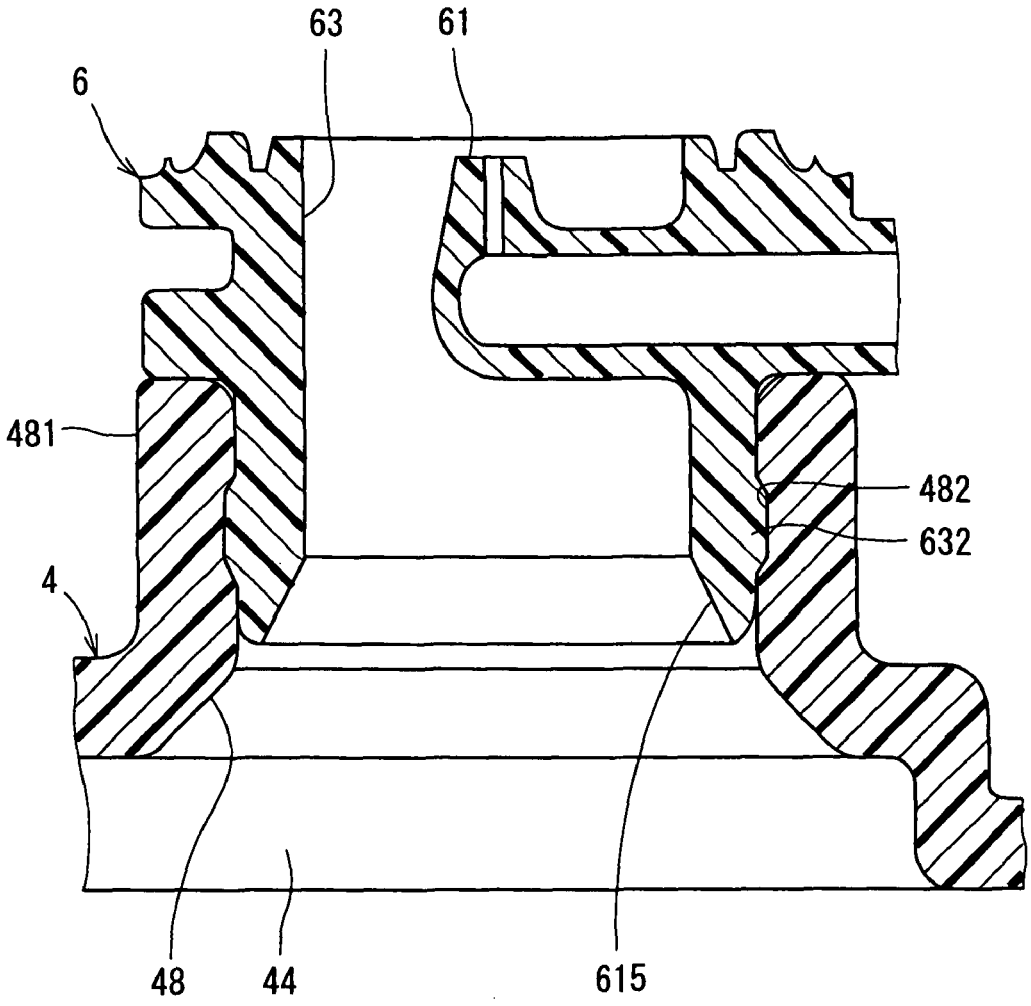
FIG. 3 is an enlarged schematic cross-sectional view showing a connection between a jet pump unit and a sub-tank of the fuel feed apparatus in FIG. 1.

As shown in FIG. 3, the chamber member 63 has a protrusion 632 on the outer surface of the chamber member 63. The protrusion 632 protrudes radially and extends in the circumferential direction of the chamber member 63. The first passageway 48 has a recess section 482 on the inner surface of the sidewall 481 of the first passageway 48. The recess section 482 is radially recessed and extends in the circumferential direction of the first passageway 48. The protrusion 632 fits to the recess section 482, when the chamber member 63 is connected to the first passageway 48 of the sub-tank 4. The protrusion 632 deforms elastically so as to shrink the volume of the protrusion 632. Accordingly, the entire surface of the protrusion 632 is attached tightly to the recess section 482, which seals tightly between the chamber member 63 of the suction jet pump unit 6 and the first passageway 48 of the sub-tank 4. Therefore, fuel that flows through the first passageway 48 can be prevented from leaking from between the chamber member 63 of the suction jet pump unit 6 and the first passageway 48 of the sub-tank 4. Moreover, according to this structure, the first jet pump 6 cannot be easily pulled out of the sidewall 481 of the first passageway 48, even if the resin sub-tank 4 swells on exposure to fuel and is deformed.

The sidewall 492 of the second passageway 49 of the sub-tank 4 protrudes toward the inside of the sub-tank 4 in the axial direction of the sub-tank 4. The second passageway 49 is formed as a hollow-cylinder. The transfer jet pump unit 7 to supply fuel in the second tank section of the fuel tank 2 into the sub-tank 4 is mounted in the second passageway 49. The chamber member 73 has a protrusion on the outer surface of the chamber member 73, similar to protrusion 632 of chamber member 63.

The second passageway 49 has a recess section on the inner surface of the sidewall 491 of the second passageway 49, similar to recess section 482 of first passageway 48. When the chamber member 73 is connected to the second passageway 49 of the sub-tank 4, the entire surface of the protrusion of the chamber member 73 fits tightly to the recess section of the second passageway 49.

A plurality of guide members 483 that protrude axially are arranged around the first passageway 48. Each of the guide members 483 has a guide plane 484 on the upper side of the guide member 483. Each of the guide planes 484 lead the suction jet pump unit 6 into the first passageway 48, so that the suction jet pump unit 6 can be easily mounted into the first passageway 48. Similarly, a plurality of guide members 493 that protrude axially are arranged around the second passageway 49. Each of the guide members 493 has a guide plane 494 on the upper side of the guide member 493. Each of the guide planes 494 lead the transfer jet pump unit 7 into the second passageway 49, so that the transfer jet pump unit 7 can be easily mounted into the second passageway 49.

As noted above, the suction jet pump unit 6 to supply fuel in the first tank section 23 of the fuel tank 2 into the sub-tank 4 is mounted in the first passageway 48, which is a hollow cylinder that protrudes toward the inside of the sub-tank 4. Therefore, when the specifications of the suction jet pump unit 6 are altered (e.g. the shape of a jet nozzle 61, a throat pipe 62 and chamber member 63 and/or the length of an extended pipe 64 are altered), the altered suction jet pump unit can be mounted in the first passageway 48. Thus, it is not necessary to alter the structure of the fuel pump 52 and sub-tank 4 when the specifications of the suction jet pump unit are changed. Accordingly, the fuel pump 52 and the sub-tank 4 of the fuel feed apparatus 1 can be standardized regardless of the specifications of the suction jet pump unit 6.

As also noted above, the transfer jet pump unit 7 to supply fuel in the second tank section of the fuel tank 2 into the sub-tank 4 is mounted in the second passageway 49, which is a hollow cylinder that protrudes toward the inside of the sub-tank 4. Therefore, when the specifications of the transfer jet pump unit 7 are altered (e.g. the shape of a jet nozzle 71, a throat pipe 72 and chamber member 73 and/or the length of an extended pipe 74 are altered), the altered transfer jet pump unit can be mounted in the second passageway 49. Thus, it is not necessary to alter the structure of the fuel pump 52 and sub-tank 4 when the specifications of the transfer jet pump unit are changed. Accordingly, the fuel pump 52 and the sub-tank 4 of the fuel feed apparatus 1 can be standardized regardless of the specifications of the transfer jet pump unit 7.

In this embodiment, each of the throat pipes 62,72 is connected to the corresponding extended pipes 64,74 at their downstream ends. In this structure, when the length of the extended pipes 64,74 is altered, the specifications of the suction jet pump unit 6 and the transfer jet pump unit 7 are altered. However, the jet nozzle 61,71 and the throat pipe 62,72 can be standardized regardless of the specifications of the suction jet pump unit 6 and the transfer jet pump unit 7 because the extended pipes are connected thereto.

When the fuel pump 52 is stopped, fuel in the sub-tank 4 flows into the outlet port 641, and flows outside of the sub-tank 4 through the throat pipe 62, the suction port 615 and the first passageway 48. This outflow of fuel stops when the fuel level in the sub-tank 4 is the same as the outlet port 641. Accordingly, the longer the extended pipe 64,74 is, the higher fuel level in the sub-tank 4 is at the time the fuel pump 52 is stopped. As a result, the flow of fuel to be discharged by the fuel pump 52 increases, shortly after the fuel pump 52 is restarted. On the other hand, the shorter the extended pipe 64,74 is, the lower the pressure loss of fuel discharged from the suction jet pump unit 6 is.

In the above embodiment, the structure of the first passageway 48 can be the same as the second passageway 49 so that the transfer jet pump unit 7 can be mounted in the first passageway 48 and the suction jet pump unit 6 can be mounted in the second passageway 49. According to this structure, flexible location of the jet pump units 6,7 can increase the fuel pump design possibilities.

Second Embodiment

The same or similar reference numerals hereafter indicates the same or substantially the same part, portion or component as the first embodiment.

Figure 4:
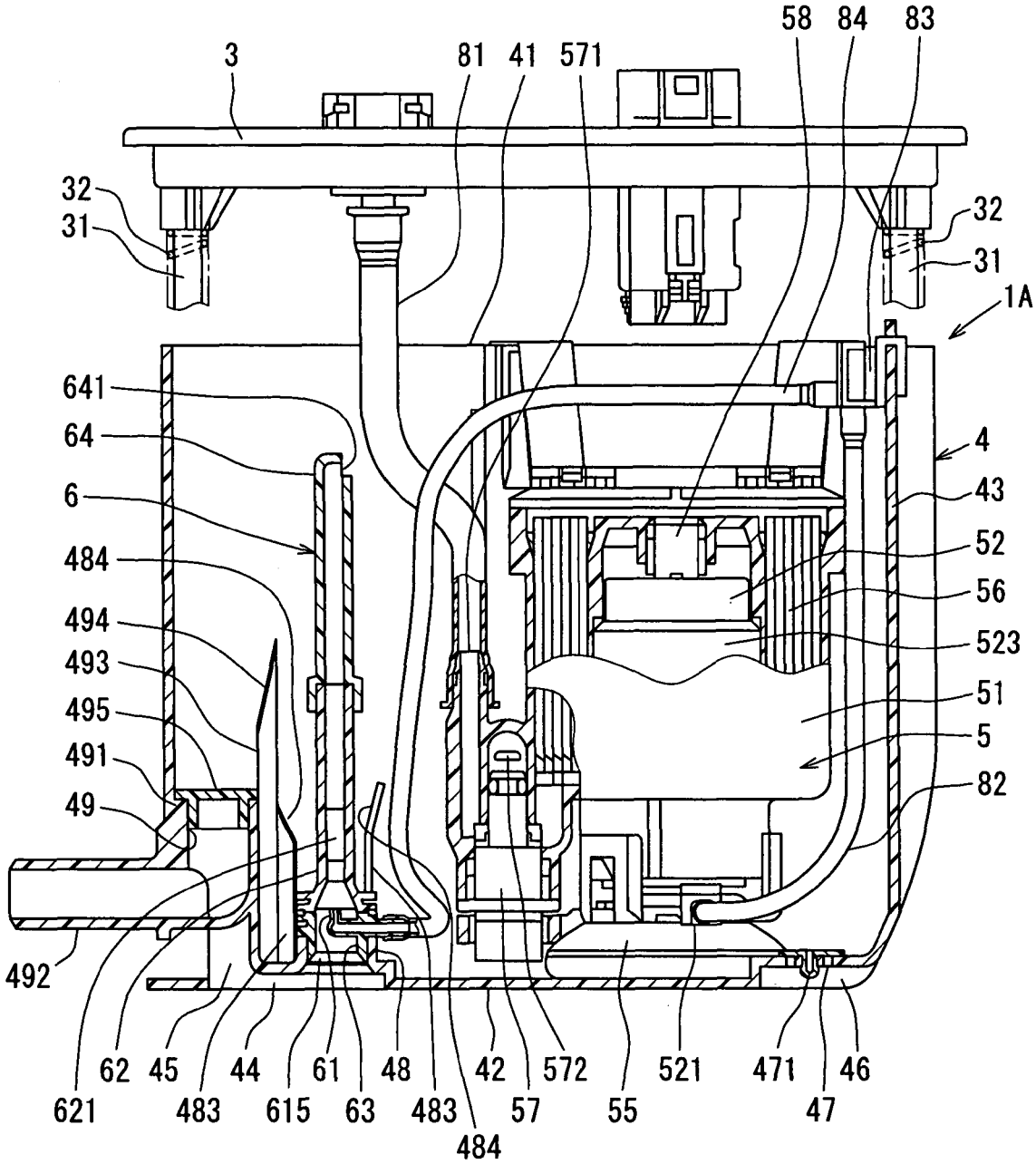
FIG. 4 is a schematic cross-sectional view showing a fuel feed apparatus according to the second embodiment of the present invention.

As shown in FIG. 4, a fuel feed apparatus 1A includes the suction jet pump unit 6 and does not include the transfer jet pump unit 7. A cover 495 is mounted in the second passageway 49 of the fuel feed apparatus 1A. Thus, the second passageway 49 is covered with the cover 495, so that the cover 495 can prevent fuel in the sub-tank 4 from flowing out of the sub-tank 4. Accordingly, the fuel feed apparatus 1A can include the fuel pump 52 and the sub-tank 4 that is the same fuel pump and the sub-tank of the fuel feed apparatus 1 (shown in FIG. 1), regardless of the presence or absence of the transfer jet pump unit 7.

Third Embodiment

Figure 5:
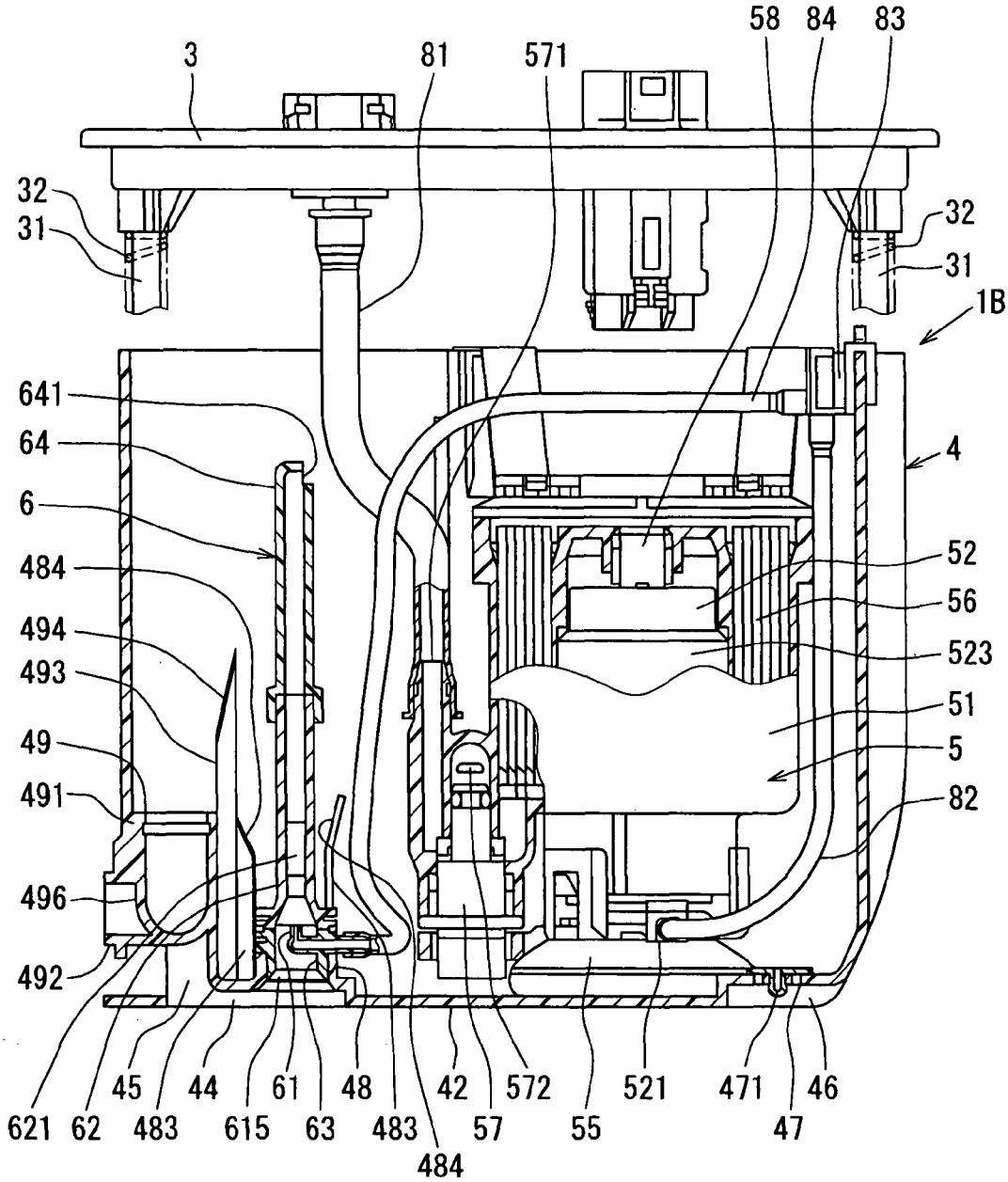
FIG. 5 is a schematic cross-sectional view showing a fuel feed apparatus according to the third embodiment of the present invention.

As shown in FIG. 5, a fuel feed apparatus 1B includes a cover 496 that covers the second passageway 49. The cover 496 and the sub-tank 4 are integrally formed from resin. The sub-tank 4 is formed by injection molding resin. In this case, a part of the injection mold (not shown) has a nested structure to form the cover 496. Moreover, a couple of nesting members are prepared. Specifically, one nesting member is for forming the cover 496 described in this embodiment, and another nesting member is for forming the part corresponding to the cover 496 in the sub-tank 4 described in the first embodiment. According to this structure, both the sub-tank 4 of the fuel feed apparatus 1 (in the first embodiment) and the sub-tank 4 of the fuel feed apparatus 1B (in this embodiment) can be formed easily by using the common injection mold which has the nested structure and by changing the nesting member appropriately.

Furthermore, in this structure, the cover 496 is positioned on the upstream side within the second passageway 49, as shown in FIG. 4. Thus, fuel in the sub-tank 4 can be stored within the second passageway 49.

Fourth Embodiment

Figure 6:
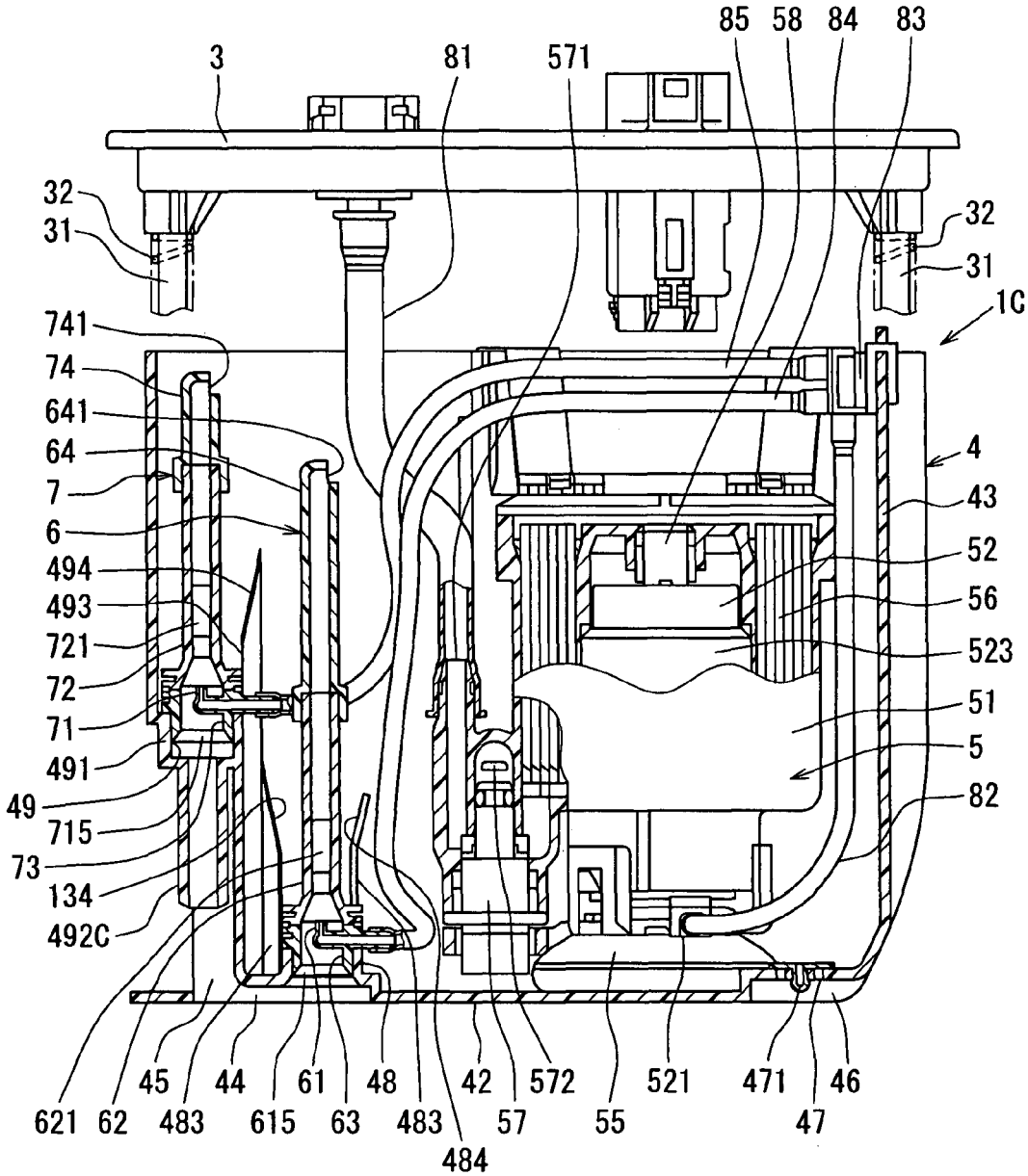
FIG. 6 is a schematic cross-sectional view showing a fuel feed apparatus according to the fourth embodiment of the present invention.

As shown in FIG. 6, a fuel feed apparatus 1C includes a connector 492C that protrudes downward from the second passageway 49 of the sub-tank. In this structure, a transfer pipe (not shown) connected to the connector 492C is positioned immediately below the second passageway 49. The gap 45 as a space to arrange the transfer pipe is formed between the lower end of the connector 492C and the bottom wall 42 of the sub-tank 4. According to this structure, the fuel feed apparatus 1C can be received within the fuel tank 2 easily, because the connector 492C does not protrude outwardly from the sub-tank 4.

Fifth Embodiment

Figure 7:
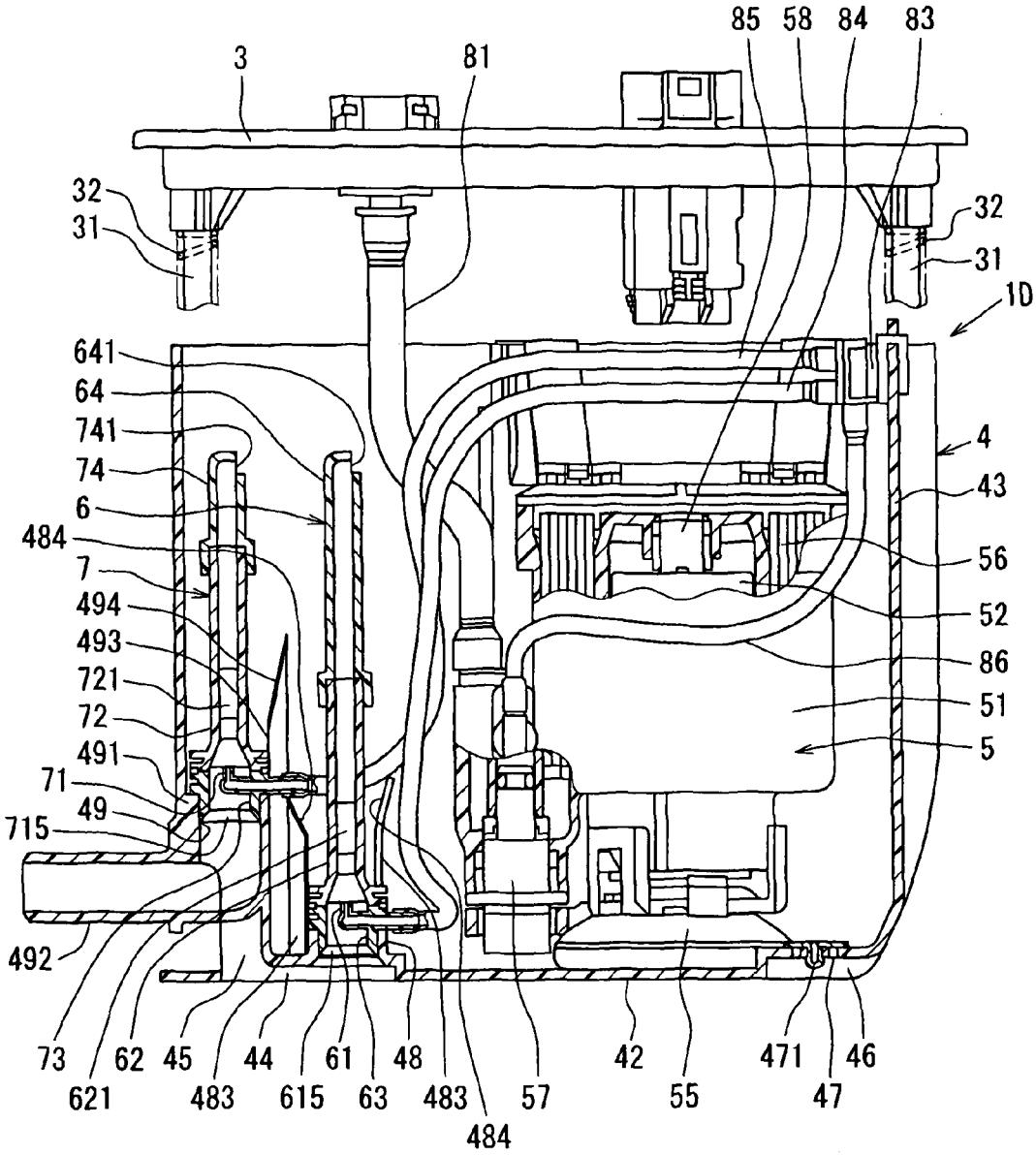
FIG. 7 is a schematic cross-sectional view showing a fuel feed apparatus according to the fifth embodiment of the present invention.

As shown in FIG. 7, a fuel feed apparatus 1D does not include the pipe 82 (as shown in FIG. 1) that connects the joint member 83 and the pump housing of the fuel pump 52. Instead, a pipe 86 connects the joint member 83 and the drain port 572 (shown in FIG. 1) of the pressure regulator 57. In this structure, the return fuel that flows from the drain port 572 of the pressure regulator 57 can be divided and supplied to the jet pump units 6,7 through the pipe 86 and the joint member 83.

Sixth Embodiment

Figure 8:
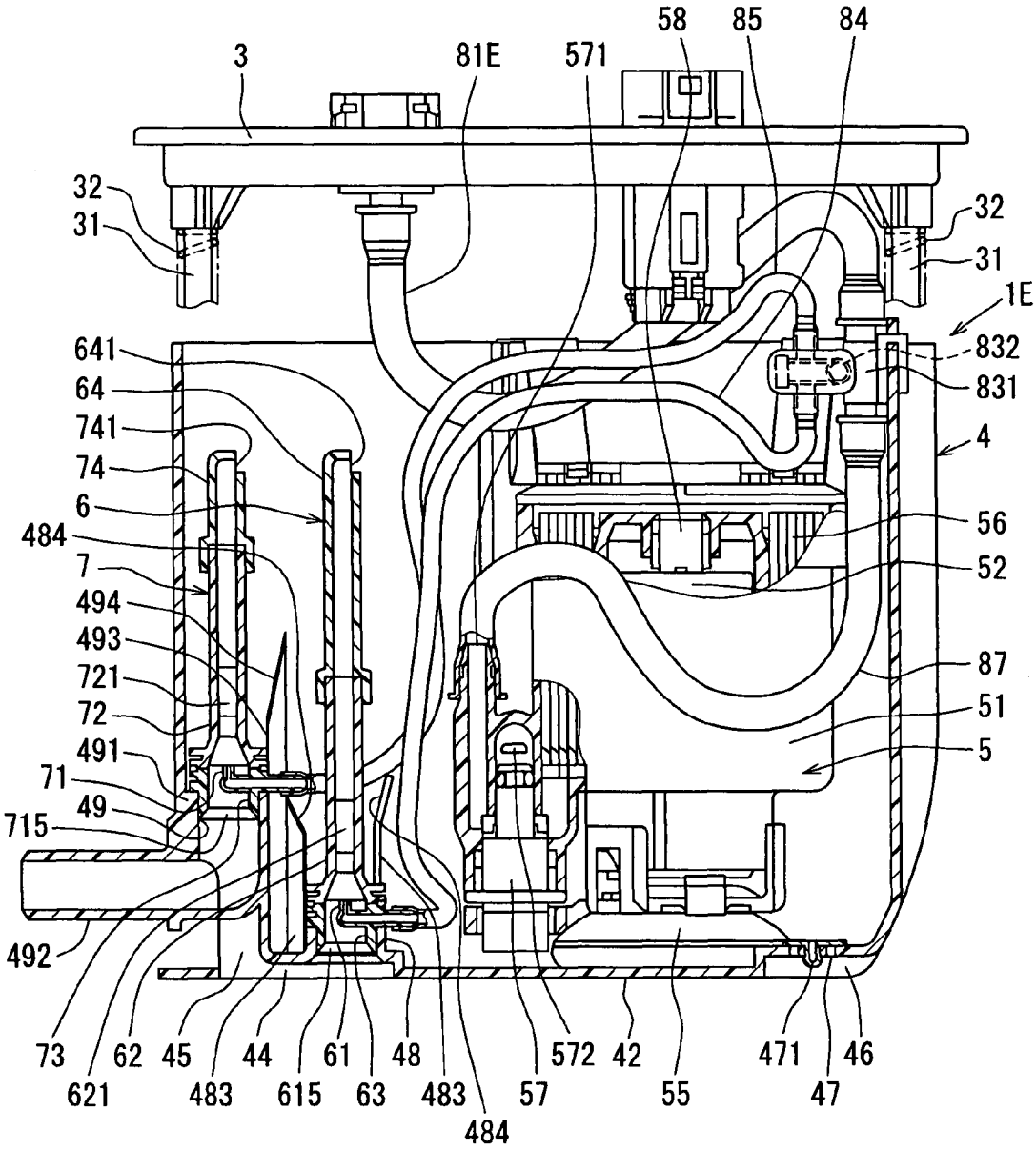
FIG. 8 is a schematic cross-sectional view showing a fuel feed apparatus according to the sixth embodiment of the present invention.

As shown in FIG. 8, a fuel feed apparatus 1E does not include the pipe 86 (as shown in FIG. 7) that connects the joint member 83 and the drain port 572 of the pressure regulator 57. Instead, a pipe 87 connects a joint member 831 and the discharge port 571 of the pressure regulator 57. Fuel that flows from the discharge port 571 of the pressure regulator 57 through pipe 57 (high-pressurized fuel) can be divided at the joint member 831 and supplied to the pipes 81E,84,85 and the outside of the fuel tank 2.

In this structure, when fuel pressure in the pipes 81E,87 is maintained at a predetermined pressure, even if fuel pump 52 is stopped, the discharge pressure of fuel that is discharged to the outside of the fuel tank 2 can be increased immediately to a predetermined discharge pressure when the fuel pump 52 is restarted. In view of this, the check valve 58 is provided in the casing 51 of the pump module 5, and a residual pressure holding valve 832 is provided in the joint member 831.

The check valve 58 can prevent fuel in the pipe 87 from flowing back within the fuel pump 52 and draining from the suction filter 55, when the fuel pump 52 is stopped. As a result, when the fuel pump 52 is stopped, fuel pressure in the pipe 87 can be maintained at a predetermined pressure.

The residual pressure holding valve 832 can prevent fuel in pipe 81E from flowing back into pipes 84,85 and draining from the jet pump units 6,7, when the fuel pump 52 is stopped. As a result, when the fuel pump 52 is stopped, fuel pressure in each of the pipes 81E and 87 can be maintained at a predetermined pressure.

The residual pressure holding valve 832 opens when a fuel pressure on the upstream side of the residual pressure holding valve 832 is higher than a predetermined pressure, and closes when a fuel pressure on the upstream side of the residual pressure holding valve 832 is lower than the predetermined pressure. The predetermined pressure is set lower than the discharge pressure of fuel discharged from the discharge port 571 of the pressure regulator 57. Thus, the residual pressure holding valve 832 opens when the fuel pump is operated, the residual pressure holding valve 832 closes when the fuel pump is stopped and the discharge pressure of fuel discharged from the discharge port 571 of the pressure regulator 57 decreases to the predetermined pressure.

Seventh Embodiment

Figure 9:
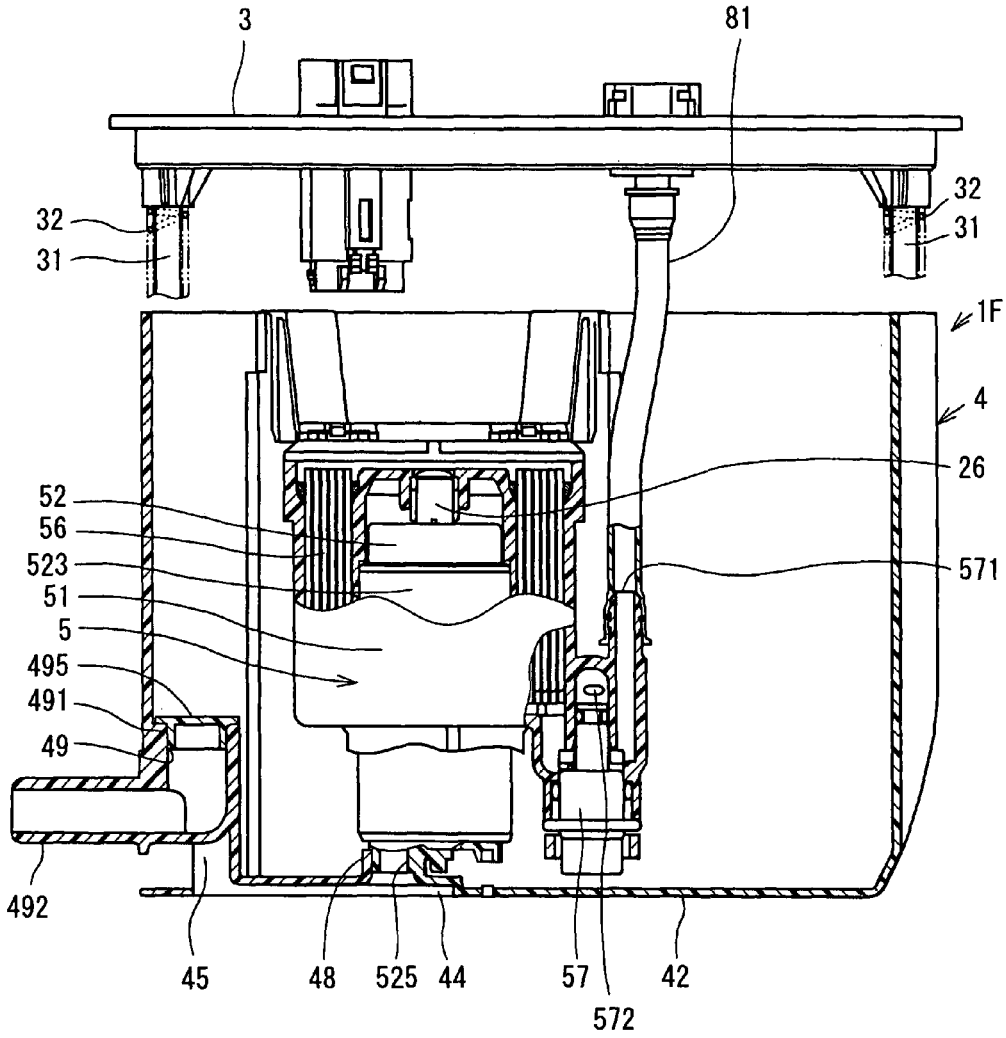
FIG. 9 is a schematic cross-sectional view showing a fuel feed apparatus according to the seventh embodiment of the present invention.

As shown in FIG. 9, a fuel feed apparatus 1F does not include the jet pump units 6,7 and the suction filter 55. A suction port 525 of the fuel pump 52 is mounted in the first passageway 48 directly. Moreover, the cover 495 is mounted in the second passageway 49 of the fuel feed apparatus 1F, as described in the second embodiment.

As described above, the fuel feed apparatus 1F includes the same first passageway 48 as the fuel feed apparatus 1 (shown in FIG. 1) includes. Therefore, commonality of the fuel pump 52 and the sub-tank 4 can be easily enabled between the fuel feed apparatus 1 described in the first embodiment and the fuel feed apparatus 1F described in the seventh embodiment.

Eighth Embodiment

Figure 10:
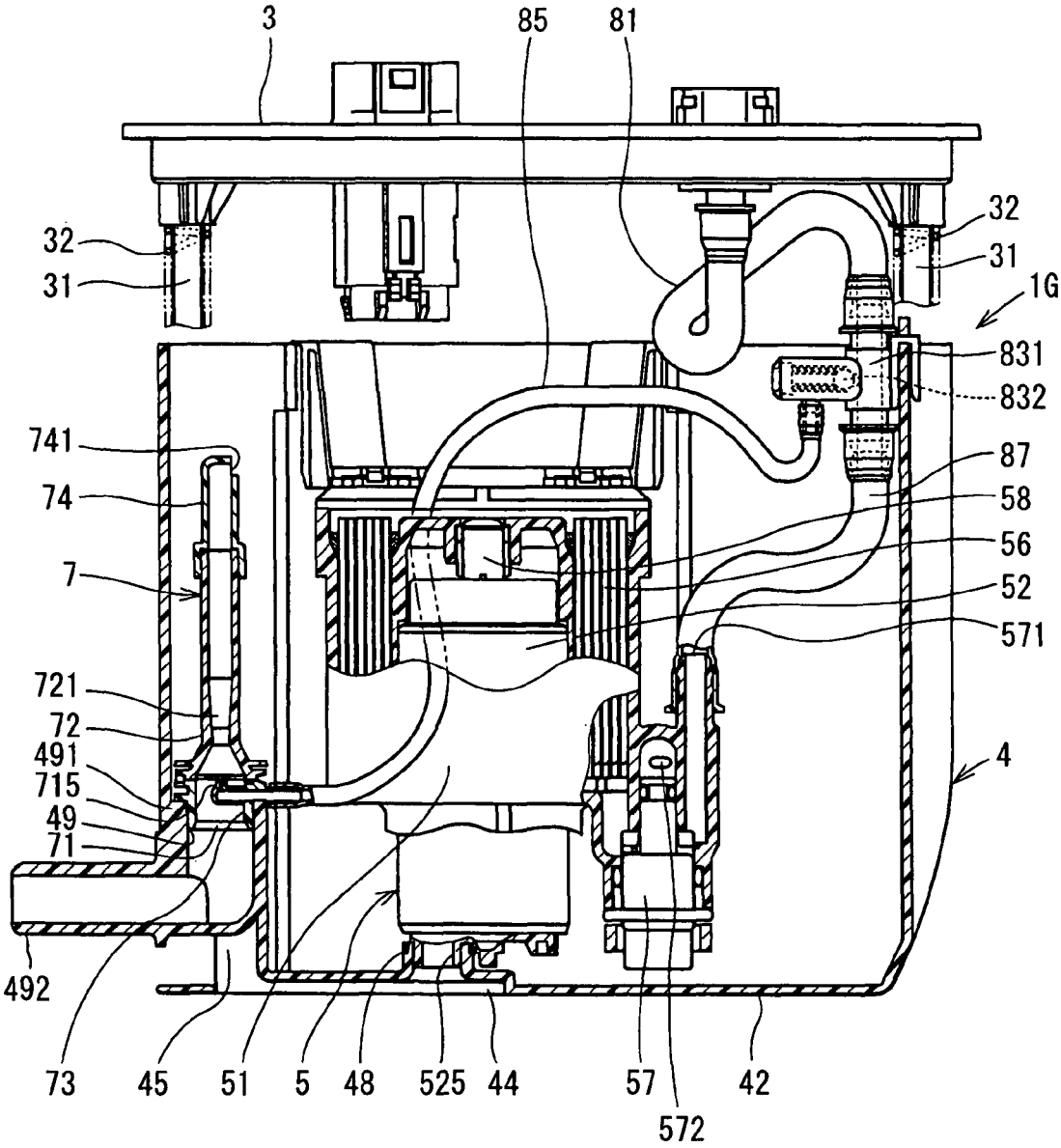
FIG. 10 is a schematic cross-sectional view showing a fuel feed apparatus according to the eighth embodiment of the present invention.

As shown in FIG. 10, a fuel feed apparatus 1G does not include the suction jet pump unit 6 and the suction filter 55, but does include the transfer jet pump unit 7. A suction port 525 of the fuel pump 52 is mounted in the first passageway 48 directly.

Compared to the fuel feed apparatus 1F described in the seventh embodiment (shown in FIG. 9), the fuel feed apparatus 1G includes the same first passageway 48 and the second passageway 49 as the fuel feed apparatus 1F. Therefore, commonality of the fuel pump 52 and the sub-tank 4 can be easily enabled between the fuel feed apparatus 1F of the seventh embodiment and the fuel feed apparatus 1G of the eighth embodiment.

Ninth Embodiment

Figure 11:
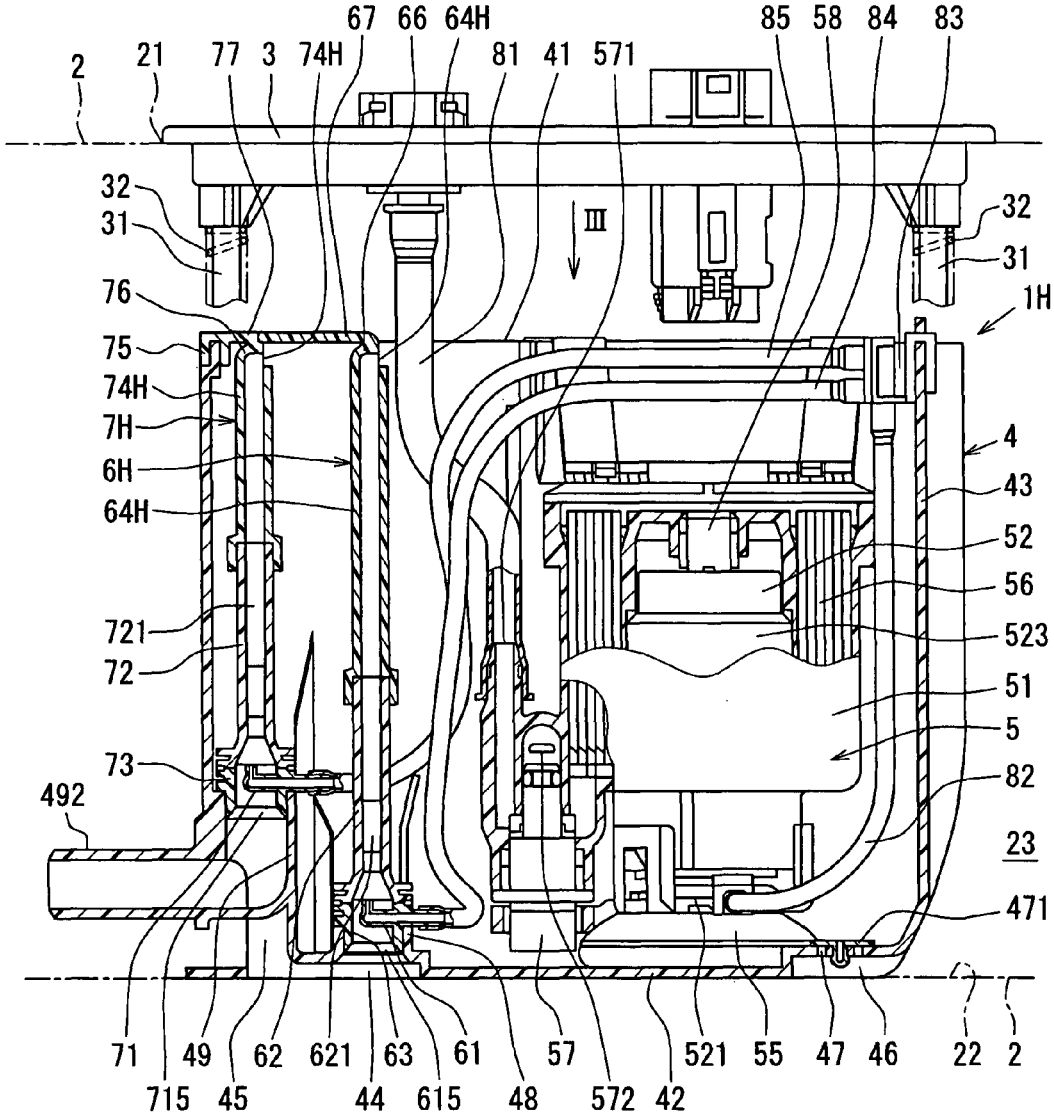
FIG. 11 is a schematic cross-sectional view showing a fuel feed apparatus accommodated in a fuel tank according to the ninth embodiment of the present invention.
Figure 13:
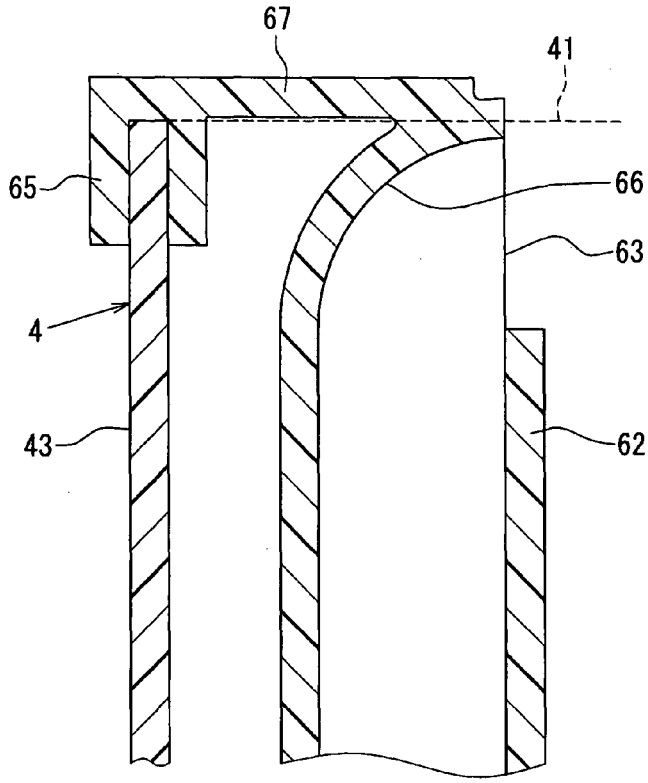
FIG. 13 is an enlarged schematic cross-sectional view showing a downstream end of a jet pump unit of the fuel feed apparatus in FIG. 11.

As shown in FIGS. 11 and 13, a curved section 66 to change the flow direction of fuel is formed on the upper end of an extended pipe 64H of a fuel feed apparatus 1H. The outlet port 641H is positioned on the downstream side of the curved section 66, and is opened toward the inside of the sub-tank 4 in the substantially horizontal direction, as shown in FIG. 13. The curved section 66 has a spherical inner surface (smoothly-curved surface which has a curvature radius R), so as to reduce the pressure loss of the fuel flowing from the throat pipe 62. In this structure, fuel flowing through the throat pipe 62 in the axial direction of the suction jet pump unit 6H can be changed into flowing in the direction perpendicular to the axis of the suction jet pump unit 6H. Fuel that is changed flow direction at the curved section 66 can be discharged from the outlet port 641H to the inside of the sub-tank 4.

A first joint member 67 is provided at the downstream end of the extended pipe 64H. The first joint member 67 has a engaging member 65 which can engage in a way as to clip onto the upper edge of the sidewall 43 of the sub-tank 4, as shown in FIG. 13. Accordingly, the suction jet pump unit 6H can be steadily fixed to the sub-tank 4 by a combination of the chamber member 63 fixed at the upstream end of the suction jet pump unit 6H and the first joint member 67 fixed at the downstream end of the suction jet pump unit 6H.

Similarly, a curved section 76 to change the flow direction of fuel is formed on the upper end of an extended pipe 74H of a fuel feed apparatus 1H. The outlet port 741H is positioned on the downstream side of the curved section 76, and is opened toward the inside of the sub-tank 4 in the substantially horizontal direction, as shown in FIG. 11. The curved section 76 has a spherical inner surface (smoothly-curved surface which has a curvature radius R), so as to reduce the pressure loss of the fuel flowing from the throat pipe 72. In this structure, fuel flowing through the throat pipe 72 in the axial direction of the transfer jet pump unit 7H can be changed into flowing in the direction perpendicular to the axis of the transfer jet pump unit 7H. Fuel that is changed flow direction at the curved section 76 can be discharged from the outlet port 741H to the inside of the sub-tank 4.

A second joint member 77 is provided at the downstream end of the extended pipe 74H. The second joint member 77 has a engaging member 75 which can engage in a way as to clip onto the upper edge of the sidewall 43 of the sub-tank 4. Accordingly, the transfer jet pump unit 7H can be steadily fixed to the sub-tank 4 by a combination of the chamber member 73 fixed at the upstream end of the transfer jet pump unit 7H and the second joint member 77 fixed at the downstream end of the transfer jet pump unit 7H.

In this structure, when the fuel pump 52 is stopped, fuel in the sub-tank 4 flows out of the sub-tank 4 through the outlet ports 641H,741H, the extended pipes 64H,74H, the throat pipes 62,72, and the passageways 48,49. This outflow of fuel stops when the fuel level in the sub-tank 4 is the same as the lower of outlet port 641H and outlet port 741H.

In this embodiment, the curved sections 66,76 which change the flow direction of fuel are formed on the extended pipes 64H,74H. Moreover, the outlet ports 641H,741H are opened toward the inside of the sub-tank 4. Therefore, fuel discharged from the outlet ports 641H,741H can be predominantly stored within the sub-tank 4. In this structure, the outlet ports 641H,741H are positioned adjacent to the upper edge of the sub-tank 4. Accordingly, more fuel can be stored within the sub-tank 4 when the fuel pump 52 is stopped. Moreover, with this structure, more fuel can be stored within the sub-tank 4 when the two jet pump units 6H,7H are received in the sub-tank 4.

In this embodiment, the suction jet pump unit 6H and the transfer jet pump unit 7H are rod-like in shape, and have the outlet ports 641H,741H at the downstream ends of the jet pump units 6H,7H and the chamber members 63,73 at the upstream ends of the jet pump units 6H,7H, respectively. The chamber members 63,73 of the jet pump units 6H,7H are inserted and fixed into the passageways 48,49, respectively. Therefore, other passageways to supply fuel into the jet pump units 6H,7H do not need to be provided within the sub-tank 4. This structure can prevent the jet pump units 6H,7H from increasing the volume of the jet pump units 6H,7H. Accordingly, more fuel can be stored within the sub-tank 4.

In this embodiment, the jet pump units 6H,7H are provided parallel to the axial direction of the sub-tank 4 above the passageways 48,49. According to this structure, the jet pump units 6H,7H can be fixed easily by inserting them into the passageways 48,49, respectively.

Figure 12:
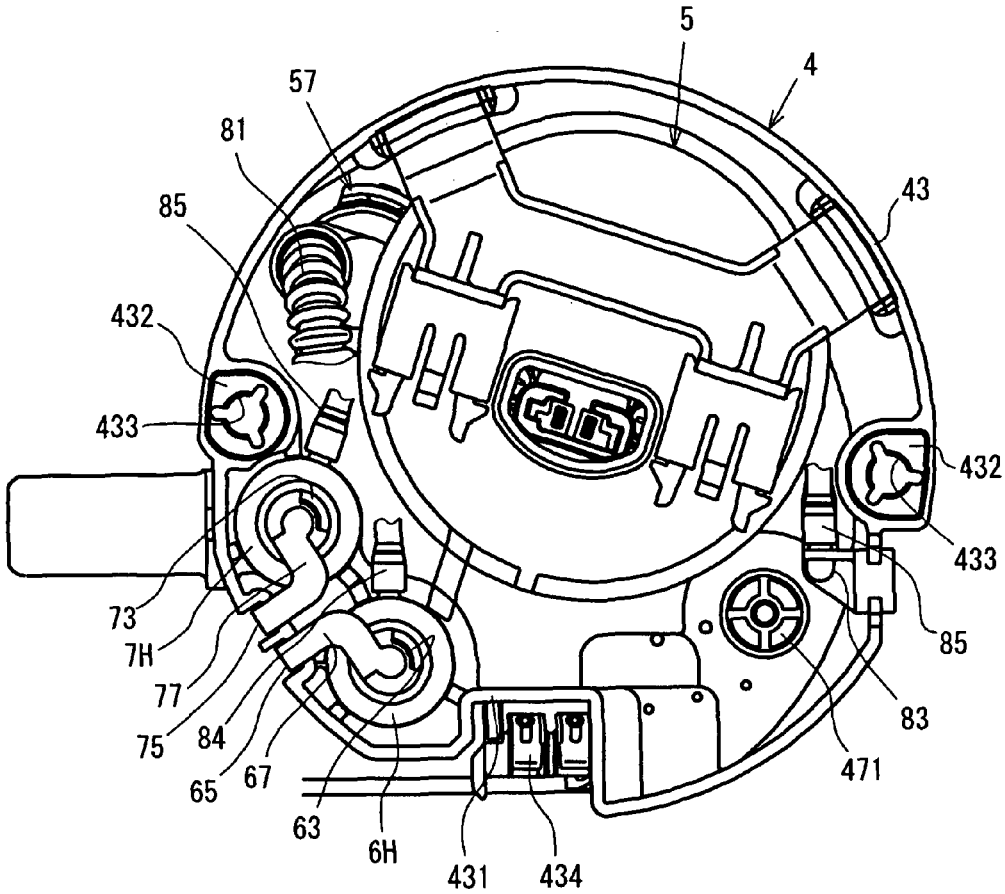
FIG. 12 is a top view from the direction III in FIG. 11.

In this embodiment, the jet pump units 6H,7H can be prevented from increasing the volume of the jet pump units 6H,7H, as described above. Moreover, jet pump units 6H,7H can be received within the space between the step section 431 and the insertion sections 432 of the sub-tank 4, as shown in FIG. 12. Thus, the fuel feed apparatus 1H can be prevented from increasing the diametrical size of the sub-tank 4. Accordingly, the fuel feed apparatus 1H can be received easily within the fuel tank 2 through the opening of the fuel tank 2.

Figure 14:
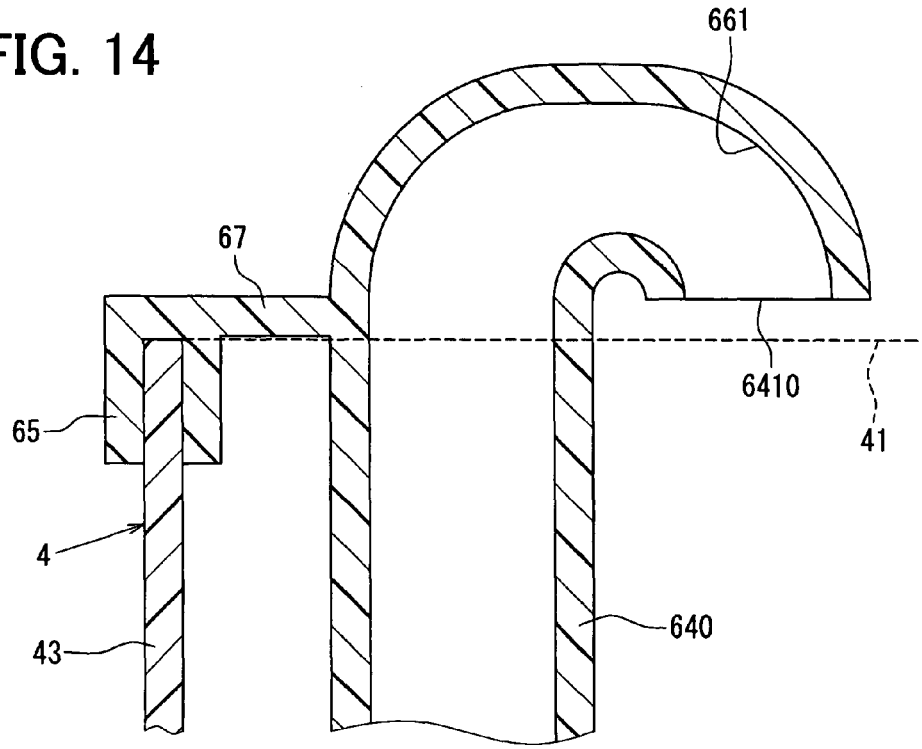
FIG. 14 is an enlarged schematic cross-sectional view showing a modified downstream end of a jet pump unit in FIG. 13.

Moreover, the extended pipes 64,74 can be altered, as shown in FIG. 14. A curved section 661 to change the flow direction of fuel is formed on the upper end of an extended pipe 640. The curved section 661 is U-shaped. The outlet port 6410 is positioned on the downstream side of the curved section 661, and is opened toward the bottom of the sub-tank 4. In this structure, fuel flowing through the throat pipe 62 in the axial direction of the suction jet pump unit 6 can be changed into flowing toward the bottom of the sub-tank 4. Fuel that is changed flow direction at the curved section 661 can be discharged from the outlet port 6410 to the inside of the sub-tank 4. In this structure, the outlet port 6410 can be positioned above the upper opening 41 of the sub-tank 4, so that more fuel can be stored within the sub-tank 4.

Tenth Embodiment

Figure 15:
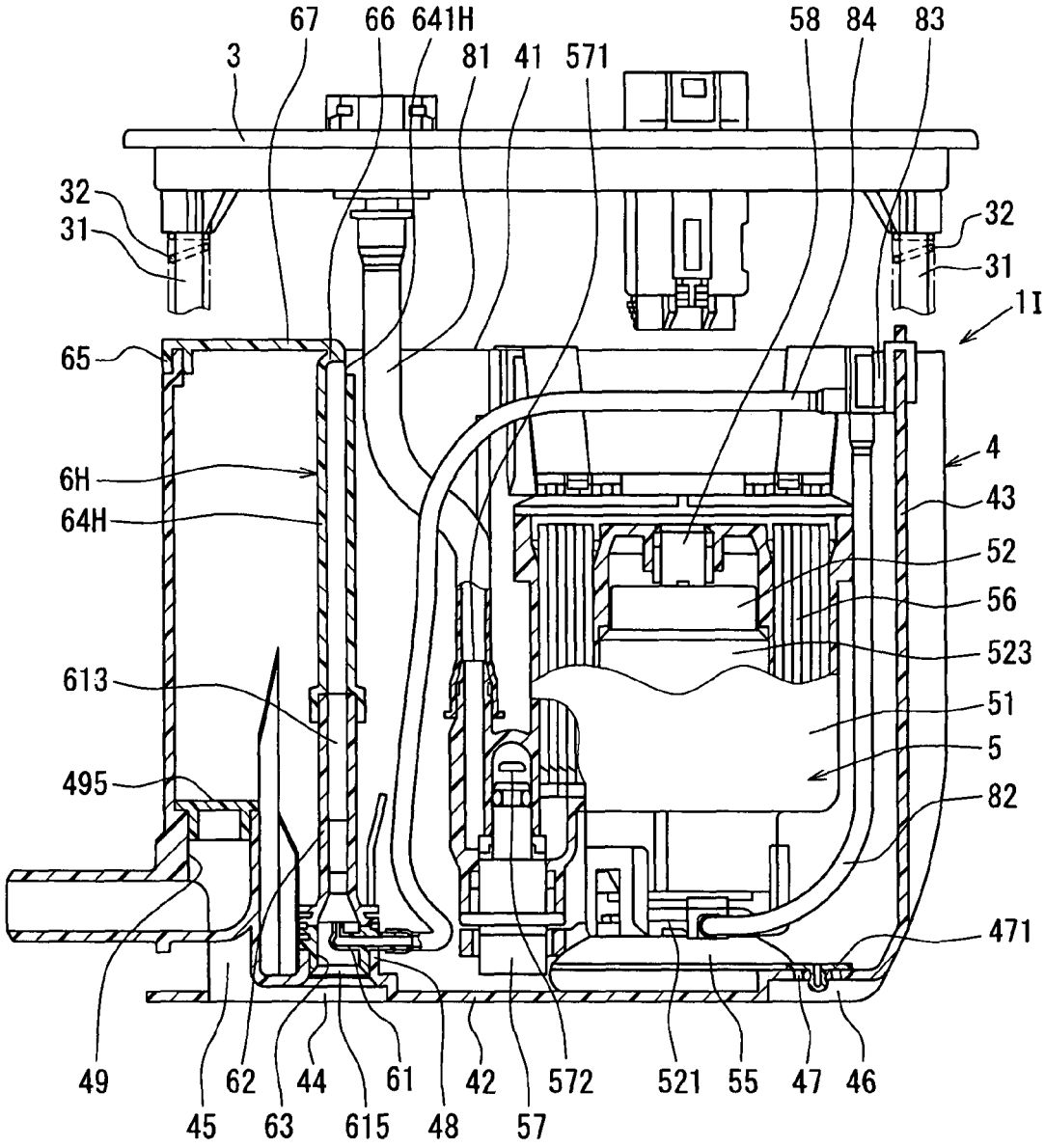
FIG. 15 is a schematic cross-sectional view showing a fuel feed apparatus according to the tenth embodiment of the present invention.

As shown in FIG. 15, a fuel feed apparatus 1I includes the suction jet pump unit 6H but does not include the transfer jet pump unit 7. A cover 495 is mounted in the second passageway 49 of the fuel feed apparatus 1I. Thus, the second passageway 49 is covered with the cover 495, so that the cover 495 can prevent fuel in the sub-tank 4 from flowing out of the sub-tank 4. The suction jet pump 6H is the same as the one described in the ninth embodiment. Therefore, more fuel can be stored within the sub-tank 4, as described in the ninth embodiment. Especially, in this embodiment, the fuel feed apparatus 1I has no transfer jet pump unit 7. Accordingly, more fuel can be stored within the sub-tank 4, as compared to the sub-tank described in the ninth embodiment.

Eleventh Embodiment

Figure 16:
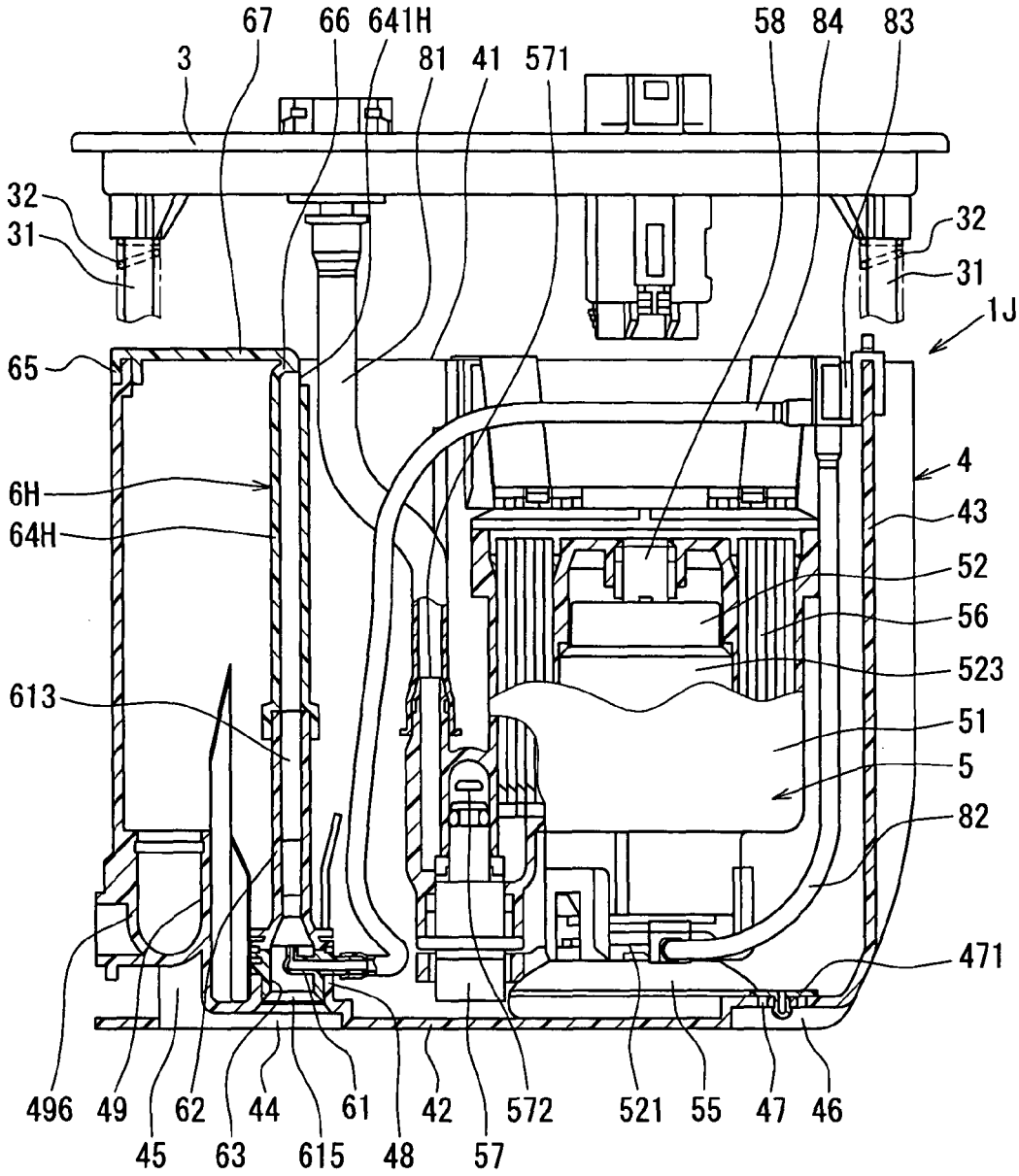
FIG. 16 is a schematic cross-sectional view showing a fuel feed apparatus according to the eleventh embodiment of the present invention.

As shown in FIG. 16, a fuel feed apparatus 1J includes a cover 496 that covers the second passageway 49. The cover 496 and the sub-tank 4 are integrally formed of resin. In this structure, the cover 496 is positioned on the upstream side within the second passageway 49, as in the embodiment of FIG. 5. Thus, fuel in the sub-tank 4 can be stored within the second passageway 49. The suction jet pump 6H is the same as the one described in the ninth embodiment. Therefore, more fuel can be stored within the sub-tank 4, as described in the ninth embodiment.

Twelfth Embodiment

Figure 17:
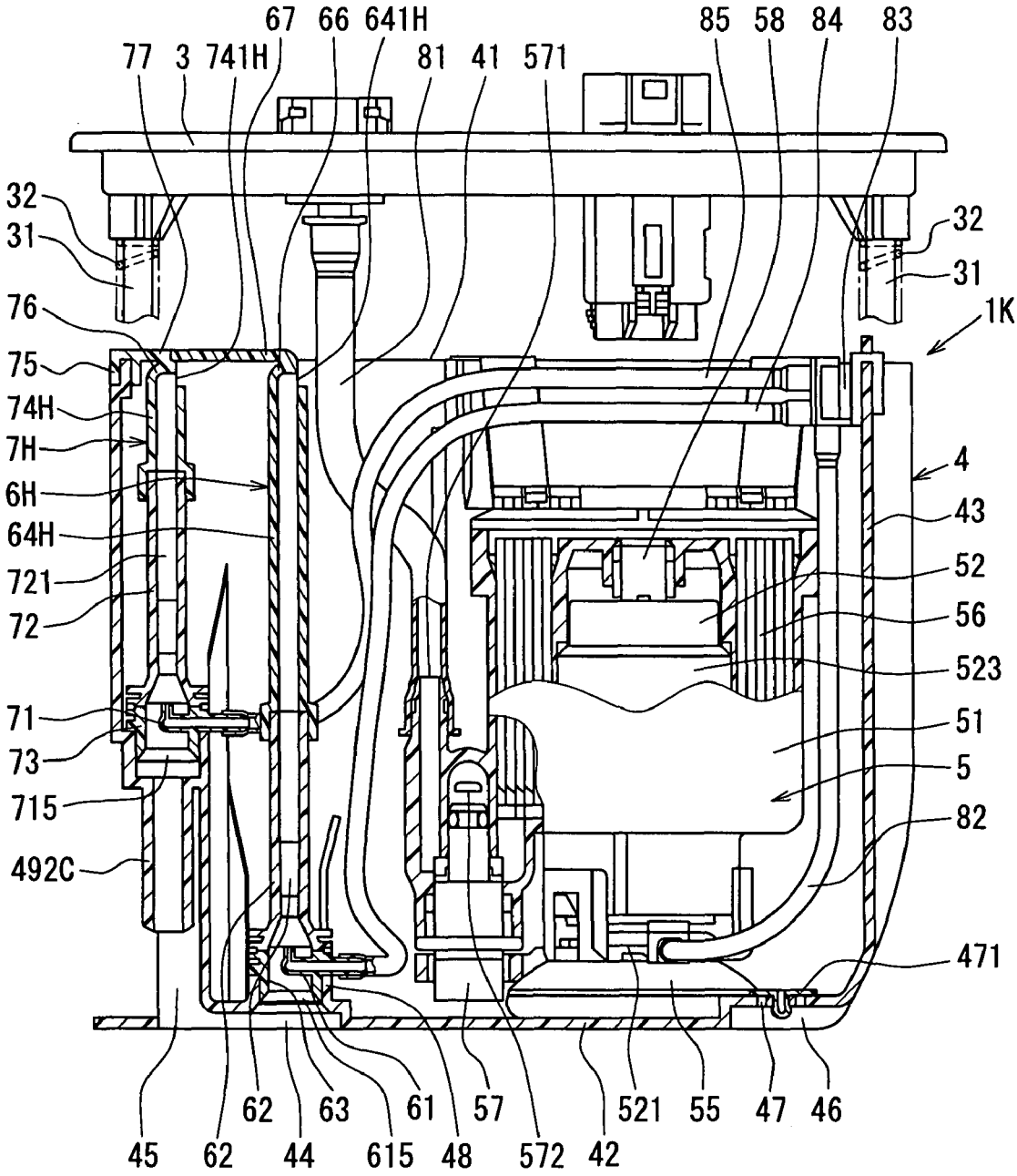
FIG. 17 is a schematic cross-sectional view showing a fuel feed apparatus according to the twelfth embodiment of the present invention.

As shown in FIG. 17, a fuel feed apparatus 1K includes a connector 492C that protrudes downward from the second passageway 49 of the sub-tank, as in the embodiment of FIG. 6. In this structure, a transfer pipe (not shown) connected to the connector 492C is positioned immediately below the second passageway 49. According to this structure, the fuel feed apparatus 1K can be received within the fuel tank 2 easily, because the connector 492C does not protrude outwardly from the sub-tank 4.

Furthermore, in this embodiment, the suction jet pump 6H and the transfer jet pump 7H are the same as the ones described in the ninth embodiment. Therefore, more fuel can be stored within the sub-tank 4. The fuel feed apparatus in this embodiment has the same advantage as the one described in the ninth embodiment.

Thirteenth Embodiment

Figure 18:
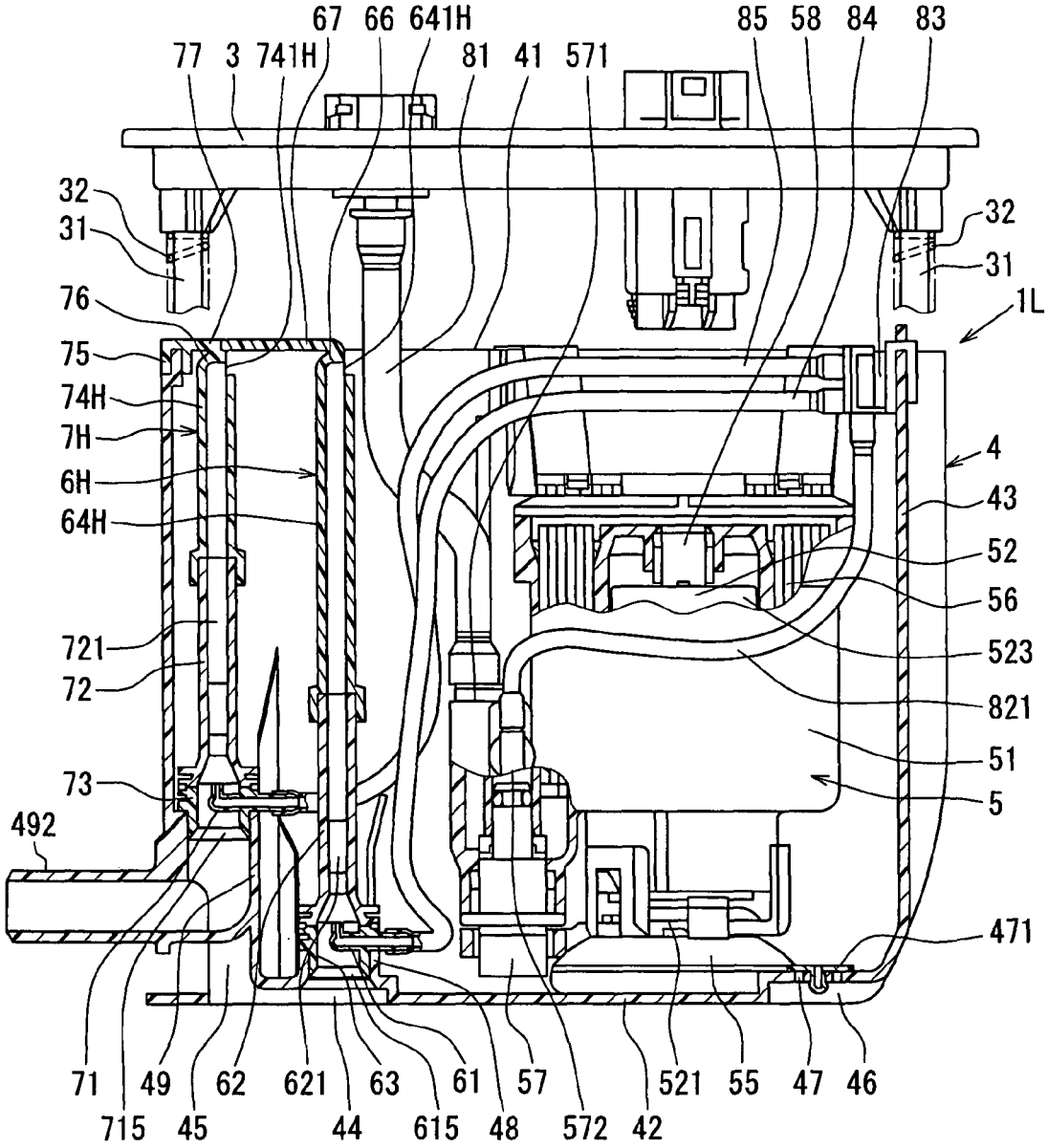
FIG. 18 is a schematic cross-sectional view showing a fuel feed apparatus according to the thirteenth embodiment of the present invention.

As shown in FIG. 18, a fuel feed apparatus 1L does not include the pipe 82 (as shown in FIG. 11) that connects the joint member 83 and the pump housing of the fuel pump 52. Instead, a pipe 86 connects the joint member 83 and the drain port 572 of the pressure regulator 57, as in the embodiment of FIG. 7. In this structure, the return fuel that flows from the drain port 572 of the pressure regulator 57 can be divided and supplied to the jet pump units 6H,7H through the pipe 86 and the joint member 83.

Furthermore, in this embodiment, the suction jet pump 6H and the transfer jet pump 7H are the same as the ones described in the ninth embodiment. Therefore, more fuel can be stored within the sub-tank 4. The fuel feed apparatus in this embodiment has the same advantage as the one described in the ninth embodiment.

Fourteenth Embodiment

Figure 19:
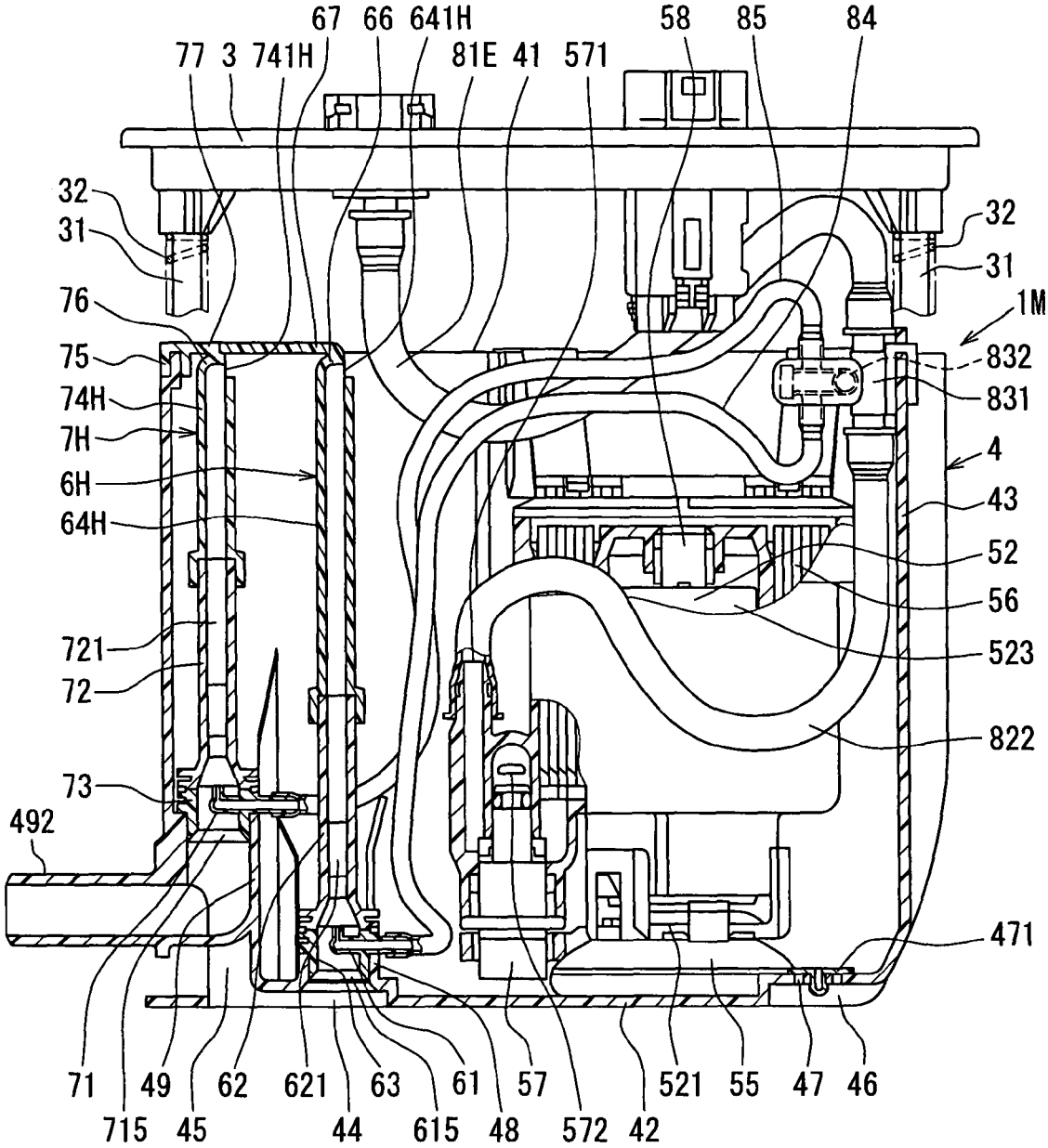
FIG. 19 is a schematic cross-sectional view showing a fuel feed apparatus according to the fourteenth embodiment of the present invention.

As shown in FIG. 19, a fuel feed apparatus 1M does not include the pipe 86 that connects the joint member 83 and the drain port 572 of the pressure regulator 57. Instead, a pipe 87 that connects a joint member 831 and the discharge port 571 of the pressure regulator 57, as in the embodiment of FIG. 8. Fuel that flows from the discharge port 571 of the pressure regulator 57 through the pipe 87 (high-pressure fuel) can be divided at the joint member 831 and supplied to the pipes 81E,84,85 and the outside of the fuel tank 2.

In this structure, when fuel pressure in the pipes 81E,87 is maintained at a predetermined pressure, even if fuel pump 52 is stopped, the discharge pressure of fuel that is discharged to the outside of the fuel tank 2 can be increased immediately to a predetermined discharge pressure when the fuel pump 52 is restarted. In view of this, the check valve 58 is provided in the casing 51 of the pump module 5, and a residual pressure holding valve 832 is provided in the joint member 831.

The check valve 58 can prevent fuel in the pipe 87 from flowing back within the fuel pump 52 and draining from the suction filter 55, when the fuel pump 52 is stopped. As a result, when the fuel pump 52 is stopped, fuel pressure in the pipe 87 can be maintained at a predetermined pressure.

The residual pressure holding valve 832 can prevent fuel in pipe 81E from flowing back into pipes 84,85 and draining from the jet pump units 6H,7H, when the fuel pump 52 is stopped. As a result, when the fuel pump 52 is stopped, at a fuel pressure in each of the pipes 81E and 87 can be maintained at a predetermined pressure.

The residual pressure holding valve 832 opens when a fuel pressure on the upstream side of the residual pressure holding valve 832 is higher than a predetermined pressure, and closes when a fuel pressure on the upstream side of the residual pressure holding valve 832 is lower than the predetermined pressure. The predetermined pressure is set lower than the discharge pressure of fuel discharged from the discharge port 571 of the pressure regulator 57. Thus, the residual pressure holding valve 832 opens when the fuel pump is operated. On the other hand, the residual pressure holding valve 832 closes when the fuel pump is stopped, and the discharge pressure of fuel discharged from the discharge port 571 of the pressure regulator 57 decreases to the predetermined pressure.

Furthermore, in this embodiment, the suction jet pump 6H and the transfer jet pump 7H are the same as the ones described in the ninth embodiment. Therefore, more fuel can be stored within the sub-tank 4. The fuel feed apparatus in this embodiment has the same advantage as the one described in the ninth embodiment.

(Variation)

In the above embodiments, the suction jet pump unit 6 is mounted in the first passageway 48 by fitting the protrusion 632 into the recess section 482, so that sealing performance can be ensured between the suction jet pump unit 6 and the first passageway 48.

However, the fuel feed apparatus may have a structure in which a sealing member (e.g. O-ring) is provided between the suction jet pump unit 6 and the first passageway 48. In this case, the suction jet pump unit 6 and the first passageway 48 may have a structure (e.g. a snap-fit latch) to fix the suction jet pump unit 6 in the first passageway 48. Similarly, the fuel feed apparatus may have a structure in which a sealing member (e.g. O-ring) is provided between the transfer jet pump unit 7 and the second passageway 49.

In the above embodiments, a plurality of guide members 483,493 that protrude axially are arranged around the corresponding wall 131,152. However, the guide members 483, 493 may be hollow-cylindrically formed, respectively.

In the above embodiments, other than the fourth embodiment, the gap 45 is formed between the bottom wall 22 of the fuel tank 2 and the connector 492. However, the connector 492 may come into contact with the bottom wall 22 of the fuel tank 2.

Various other modifications and alternations may be made to the above embodiments without departing from the spirit of the present invention. Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel feed apparatus that supplies fuel in a fuel tank to an outside of the fuel tank, the fuel feed apparatus comprising:

a sub-tank that is received in the fuel tank and has a bottom wall; and a fuel pump that is received in the sub-tank and pumps fuel in the sub-tank toward the outside of the fuel tank;

wherein:

the bottom wall of the sub-tank has a first passageway extending in the axial direction of the sub-tank, to which a suction jet pump unit to suction fuel in the fuel tank into the sub-tank can be selectively mounted, and the sub-tank has the bottom wall that has a second passageway extending in the axial direction of the sub-tank, to which a transfer jet pump unit to transfer fuel in the fuel tank into the sub-tank can be selectively mounted, further comprising:

a transfer jet pump unit mounted to the second passageway to suction fuel in the fuel tank into the sub-tank, wherein:

the transfer jet pump unit includes a second suction port that is positioned at the upstream end and is communicated with the outside of the sub-tank, and a second outlet port that is positioned adjacent to the upper edge of the sub-tank and is opened at the downstream end toward the inside of the sub-tank, and further comprising:

insertion sections which are formed in such a manner that the sidewall of the sub-tank is recessed in the diametrical direction of the sub-tank so that shafts connected with a flange to cover an opening on the upper wall of the fuel tank are slidably inserted thereinto, and a step section which are formed in such a manner that the sidewall of the sub-tank is partially recessed in the diametrical direction of the sub-tank so that a sender gauge to measure the level of fuel in a fuel tank is provided in, wherein:

the suction jet pump unit and the transfer jet pump are received within a space between the step section and a said insertion section of the sub-tank.

2. The fuel feed apparatus according to claim 1, wherein:

the sub-tank has the bottom wall that is partially recessed in the axial direction of the sub-tank, so as to form a second step section that forms a second gap between the bottom wall of the sub-tank and the bottom wall of the fuel tank; and the second passageway is formed in the second step section to open to said second gap.

3. The fuel feed apparatus according to claim 1, further comprising:

a transfer jet pump unit mounted to the second passageway to suction fuel in the fuel tank into the sub-tank, wherein:

the transfer jet pump unit includes a second throat pipe communicated with the inside of the sub-tank, a second suction port to connect the second throat pipe and the outside of the sub-tank, and a second jet nozzle that jets fuel toward the second throat pipe, so as to generate suction power by which fuel in the fuel tank is suctioned from the second suction port through the second throat pipe.

4. The fuel feed apparatus according to claim 3, further comprising:

an second extended pipe that is joined with the second throat pipe at the downstream end of the second throat pipe and extends the length of a passageway within the transfer jet pump unit in the axial direction of the sub-tank.

5. The fuel feed apparatus according to claim 1, wherein:

the first passageway is formed at a lower position in the bottom of the sub-tank than the second passageway is formed.

6. The fuel feed apparatus according to claim 1, wherein:

the first passageway has a structure to which the transfer jet pump unit can be selectively mounted instead of the suction jet pump unit.

7. The fuel feed apparatus according to claim 6, wherein:

the second passageway has a structure to which the suction jet pump unit can be selectively mounted instead of the transfer jet pump unit.

8. A fuel feed apparatus that supplies fuel in a fuel tank to an outside of the fuel tank, the fuel feed apparatus comprising:

a sub-tank that is received in the fuel tank and has a bottom wall;

a fuel pump that is received in the sub-tank and pumps fuel in the sub-tank toward the outside of the fuel tank;

wherein:

the bottom wall of the sub-tank has a first passageway extending in the axial direction of the sub-tank, to which a suction jet pump unit to suction fuel in the fuel tank into the sub-tank can be selectively mounted, and a suction jet pump unit mounted to the first passageway to suction fuel in the fuel tank into the sub-tank, wherein:

the suction jet pump unit includes a first suction port that is positioned at the upstream end and is communicated with the outside of the sub-tank, a first outlet port that is positioned adjacent to the upper edge of the sub-tank and is opened at the downstream end toward the inside of the sub-tank, and a first joint member that is provided at the downstream end that has a engaging member which can engage so as to clip onto the upper edge of a sidewall of the sub-tank.

9. The fuel feed apparatus according to claim 8, further comprising:

a first curved section that changes fuel flowing within the suction jet pump unit in the axial direction of the suction jet pump unit into fuel flowing toward the inside of the sub-tank in a direction perpendicular to the axis of the suction jet pump unit.

10. The fuel feed apparatus according to claim 8, further comprising:

a first curved section that changes fuel flowing within the suction jet pump unit in the axial direction of the suction jet pump unit into fuel flowing toward the bottom of the sub-tank.

11. The fuel feed apparatus according to claim 9, wherein:

the first curved section has a smoothly-curved inner surface which has a curvature radius R.

12. The fuel feed apparatus according to claim 10, wherein:

the first curved section has a smoothly-curved inner surface which has a curvature radius R.

13. A fuel feed apparatus that supplies fuel in a fuel tank to an outside of the fuel tank, the fuel feed apparatus comprising:

a sub-tank that is received in the fuel tank and has a bottom wall; and a fuel pump that is received in the sub-tank and pumps fuel in the sub-tank toward the outside of the fuel tank;

wherein:

the bottom wall of the sub-tank has a first passageway extending in the axial direction of the sub-tank, to which a suction jet pump unit to suction fuel in the fuel tank into the sub-tank can be selectively mounted, and the sub-tank has the bottom wall that has a second passageway extending in the axial direction of the sub-tank, to which a transfer jet pump unit to transfer fuel in the fuel tank into the sub-tank can be selectively mounted, further comprising:

a transfer jet pump unit mounted to the second passageway to suction fuel in the fuel tank into the sub-tank, wherein:

the transfer jet pump unit includes a second suction port that is positioned at the upstream end and is communicated with the outside of the sub-tank, and a second outlet port that is positioned adjacent to the upper edge of the sub-tank and is opened at the downstream end toward the inside of the sub-tank, and the transfer jet pump unit has a second joint member that is provided at the downstream end and has a engaging member which can engage in such a way as to clip onto the upper edge of a sidewall of the sub-tank.

14. The fuel feed apparatus according to claim 13, further comprising:

a second curved section that changes fuel flowing within the transfer jet pump unit in the axial direction of the transfer jet pump unit into fuel flowing toward the inside of the sub-tank in a direction perpendicular to the axis of the transfer jet pump unit.

15. The fuel feed apparatus according to claim 13, further comprising:

a second curved section that changes fuel flowing within the transfer jet pump unit in the axial direction of the suction jet pump unit into fuel flowing toward the bottom of the sub-tank.

16. The fuel feed apparatus according to claim 14, wherein:

the second curved section has a smoothly-curved inner surface which has a curvature radius R.

17. The fuel feed apparatus according to claim 15, wherein:

the second curved section has a smoothly-curved inner surface which has a curvature radius R.

* * * * *